US009334078B2

(12) United States Patent
Riley et al.

(10) Patent No.: US 9,334,078 B2
(45) Date of Patent: May 10, 2016

(54) CAN MANUFACTURE

(71) Applicant: Crown Packaging Technology, Inc., Alsip, IL (US)

(72) Inventors: Jonathan Riley, Forest Hill, MD (US); Alain Presset, Chilton (GB); Keith Alan Vincent, Swindon (GB); Stuart Alexander Monro, Brighthampton Witney (GB)

(73) Assignee: Crown Packaging Technology, Inc., Alsip, IL (US)

( * ) Notice: Subject to any disclaimer, the term of this patent is extended or adjusted under 35 U.S.C. 154(b) by 0 days.

(21) Appl. No.: 13/653,735

(22) Filed: Oct. 17, 2012

(65) Prior Publication Data

US 2013/0134173 A1 May 30, 2013

Related U.S. Application Data

(63) Continuation of application No. 12/759,298, filed on Apr. 13, 2010, now Pat. No. 8,313,003.

(30) Foreign Application Priority Data

| | | |
|---|---|---|
| Feb. 4, 2010 | (EP) | 10152593 |
| Apr. 12, 2010 | (EP) | 10159582 |
| Apr. 12, 2010 | (EP) | 10159621 |

(51) Int. Cl.
*B65D 1/40* (2006.01)
*B65D 1/16* (2006.01)

(52) U.S. Cl.
CPC ..... *B65D 1/165* (2013.01)

(58) Field of Classification Search
CPC ..... B65D 7/00; B65D 7/02; B65D 7/04; B65D 7/06; B65D 1/12; B65D 1/14; B65D 1/16; B65D 1/165; B21D 51/26; B21D 51/2607; B21D 51/2615; B21D 51/2623; B21D 51/2346
USPC ..... 206/524.6; 220/62.12, 604, 606, 906, 220/605
See application file for complete search history.

(56) References Cited

U.S. PATENT DOCUMENTS

| | | | | |
|---|---|---|---|---|
| 2,423,708 | A | 7/1947 | Keogh et al. | |
| 2,602,411 | A | 7/1952 | Schnell | |
| 3,367,533 | A * | 2/1968 | Baker | 220/614 |
| 3,561,638 | A | 2/1971 | Morjan | |

(Continued)

FOREIGN PATENT DOCUMENTS

| | | |
|---|---|---|
| BE | 784904 | 10/1972 |
| CN | 2042821 U | 8/1989 |

(Continued)

OTHER PUBLICATIONS

International Patent Application No. PCT/EP2011/051695: International Search Report dated Apr. 7, 2011, 6 pages.

(Continued)

*Primary Examiner* — Steven A. Reynolds
*Assistant Examiner* — Javier A Pagan
(74) *Attorney, Agent, or Firm* — Baker & Hostetler LLP

(57) ABSTRACT

A metal can body formed from a base stretching, drawing, and ironing process has a base having a hardness that is greater than the raw sheet, a thickness that is less than raw sheet, and a grain aspect ratio that is elongated relative to the raw sheet.

5 Claims, 32 Drawing Sheets

(56) References Cited

U.S. PATENT DOCUMENTS

| | | | | | |
|---|---|---|---|---|---|
| 3,572,271 | A | | 3/1971 | Fraze | |
| 3,593,552 | A | | 7/1971 | Fraze | |
| 3,738,528 | A | * | 6/1973 | Kagami | 220/604 |
| 3,760,751 | A | | 9/1973 | Dunn et al. | |
| 3,820,368 | A | * | 6/1974 | Fukuzuka et al. | 72/47 |
| 3,855,862 | A | * | 12/1974 | Moller | 72/334 |
| 3,904,069 | A | * | 9/1975 | Toukmanian | 220/609 |
| 3,979,009 | A | | 9/1976 | Walker | |
| 3,998,174 | A | * | 12/1976 | Saunders | 72/349 |
| 4,020,670 | A | | 5/1977 | Bulso, Jr. et al. | |
| 4,095,544 | A | | 6/1978 | Peters et al. | |
| 4,147,271 | A | | 4/1979 | Yamaguchi | |
| 4,214,471 | A | | 7/1980 | Bulso, Jr. et al. | |
| 4,248,076 | A | | 2/1981 | Bulso, Jr. et al. | |
| 4,341,321 | A | * | 7/1982 | Gombas | 220/606 |
| 4,343,173 | A | | 8/1982 | Bulso, Jr. et al. | |
| 4,372,143 | A | | 2/1983 | Elert et al. | |
| 4,416,140 | A | | 11/1983 | Bulso, Jr. et al. | |
| 4,416,389 | A | | 11/1983 | Wilkinson et al. | |
| 4,454,743 | A | | 6/1984 | Bulso, Jr. et al. | |
| 4,483,172 | A | | 11/1984 | Bulso, Jr. et al. | |
| 4,535,618 | A | | 8/1985 | Bulso, Jr. et al. | |
| 4,685,322 | A | | 8/1987 | Clowes | |
| 4,696,177 | A | | 9/1987 | Bulso, Jr. et al. | |
| 4,732,031 | A | | 3/1988 | Bulso, Jr. et al. | |
| 4,800,743 | A | | 1/1989 | Bulso, Jr. et al. | |
| 4,826,382 | A | | 5/1989 | Bulso, Jr. et al. | |
| 5,024,077 | A | | 6/1991 | Bulso, Jr. et al. | |
| 5,058,408 | A | | 10/1991 | Leftault et al. | |
| 5,102,002 | A | | 4/1992 | Whitley | |
| 5,111,679 | A | | 5/1992 | Kobayashi et al. | |
| 5,218,849 | A | | 6/1993 | Sieger et al. | |
| 5,394,727 | A | | 3/1995 | Diekhoff et al. | |
| 5,487,295 | A | | 1/1996 | Diekhoff et al. | |
| 5,522,248 | A | | 6/1996 | Diekhoff et al. | |
| 5,605,069 | A | | 2/1997 | Jentzsch | |
| 5,622,070 | A | | 4/1997 | Bulso, Jr. | |
| 5,630,337 | A | | 5/1997 | Werth | |
| 5,689,992 | A | | 11/1997 | Saunders et al. | |
| 5,700,529 | A | | 12/1997 | Kobayashi et al. | |
| 5,749,258 | A | | 5/1998 | Werth | |
| 5,881,593 | A | | 3/1999 | Bulso, Jr. et al. | |
| 5,970,767 | A | | 10/1999 | Hartman et al. | |
| 6,063,214 | A | * | 5/2000 | Fujinaga et al. | 148/602 |
| 6,286,705 | B1 | | 9/2001 | Mihalov et al. | |
| 6,305,210 | B1 | | 10/2001 | Saunders et al. | |
| 6,505,492 | B2 | | 1/2003 | Jroski | |
| 7,124,613 | B1 | | 10/2006 | McClung | |
| 2002/0074867 | A1 | | 6/2002 | Matsuura et al. | |
| 2002/0148272 | A1 | | 10/2002 | Jroski | |
| 2006/0159989 | A1 | | 7/2006 | Bouffard | |
| 2009/0026214 | A1 | | 1/2009 | Yuan et al. | |
| 2011/0089182 | A1 | | 4/2011 | McClung et al. | |
| 2011/0186465 | A1 | | 8/2011 | Riley | |
| 2012/0255656 | A1 | * | 10/2012 | Nakagawa et al. | 148/603 |

FOREIGN PATENT DOCUMENTS

| | | | |
|---|---|---|---|
| CN | 1044925 | A | 8/1990 |
| CN | 101232993 | A | 7/2008 |
| DE | 2625170 | | 12/1977 |
| DE | 10 2007050580 | | 4/2009 |
| DE | 10 2007050581 | | 4/2009 |
| DE | 10 2008047848 | | 4/2010 |
| EP | 0425704 | | 5/1991 |
| EP | 0542552 | | 5/1993 |
| GB | 1438207 | | 6/1976 |
| GB | 2103134 | | 2/1983 |
| GB | 2286364 | | 8/1995 |
| GB | 2316029 | A | 2/1998 |
| JP | 54-61069 | | 5/1979 |
| JP | 01178325 | | 7/1989 |
| JP | 4147730 | A | 5/1992 |
| JP | 7-232230 | | 9/1995 |
| JP | 7-300124 | | 11/1995 |
| JP | 8033933 | A | 2/1996 |
| JP | 8-71674 | | 3/1996 |
| JP | 11226684 | A | 8/1999 |
| JP | 3046217 | A | 5/2000 |
| WO | WO 94/16842 | A1 | 8/1994 |
| WO | WO 02/45882 | | 6/2002 |

OTHER PUBLICATIONS

English Translation of Chinese Patent Application No. 201180016908.6: First Office Action dated May 6, 2014, 3 pages.

* cited by examiner

CAN MANUFACTURE

CROSS REFERENCE TO RELATED APPLICATIONS

This application claims priority to U.S. application Ser. No. 12/759,298, filed Apr. 13, 2010 which claims priority to European Patent Application EP10152593, filed Feb. 4, 2010; European Patent Application EP10159582, filed Apr. 12, 2010; and European Patent Application EP10159621, filed Apr. 12, 2010, the contents of which are incorporated herein by reference in their entirety.

FIELD OF THE INVENTION

This invention relates to containers, and more particularly to metal containers for food, beverages, aerosols, and the like formed from a metal sheet.

BACKGROUND

Two-piece metal containers for food and beverages are often manufactured by drawing and wall ironing (DWI, also referred to as drawing and ironing (D&I)) or drawing and re-drawing (DRD) processes. The term "two-piece" refers to i) a cup-like can body and ii) a closure that would be subsequently fastened to the open end of the can body to form the container.

In a conventional DWI (D&I) process (such as illustrated in FIGS. 6 to 10 of U.S. Pat. No. 4,095,544), a flat (typically) circular blank stamped out from a roll of metal sheet is drawn though a drawing die, under the action of a punch, to form a shallow first stage cup. This initial drawing stage does not result in any intentional thinning of the blank. Thereafter, the cup, which is typically mounted on the end face of a close fitting punch or ram, is pushed through one or more annular wall-ironing dies for the purpose of effecting a reduction in thickness of the sidewall of the cup, thereby resulting in an elongation in the sidewall of the cup. By itself, the ironing process will not result in any change in the nominal diameter of the first stage cup.

FIG. 1 shows the distribution of metal in a container body resulting from a conventional DWI (D&I) process. FIG. 1 is illustrative only, and is not intended to be precisely to scale. Three regions are indicated in FIG. 1, where:

- Region 1 represents the un-ironed material of the base. This remains approximately the same thickness as the ingoing gauge of the blank, i.e. it is not affected by the separate manufacturing operations of a conventional DWI process.
- Region 2 represents the ironed mid-section of the sidewall. Its thickness (and thereby the amount of ironing required) is determined by the performance required for the container body.
- Region 3 represents the ironed top-section of the sidewall. Typically in can making, this ironed top-section is around 50-75% of the thickness of the ingoing gauge.

In a DRD process (such as illustrated in FIGS. 1 to 5 of U.S. Pat. No. 4,095,544), the same drawing technique is used to form the first stage cup. However, rather than employing an ironing process, the first stage cup is then subjected to one or more re-drawing operations which act to progressively reduce the diameter of the cup and thereby elongate the sidewall of the cup. By themselves, most conventional re-drawing operations are not intended to result in any change in thickness of the cup material. However, taking the example of container bodies manufactured from a typical DRD process, in practice there is typically some thickening at the top of the finished container body (of the order of 10% or more). This thickening is a natural effect of the re-drawing process and is explained by the compressive effect on the material when re-drawing from a cup of large diameter to one of smaller diameter.

Note that there are alternative known DRD processes which achieve a thickness reduction in the sidewall of the cup through use of small or compound radii draw dies to thin the sidewall by stretching in the draw and re-draw stages.

Alternatively, a combination of ironing and re-drawing may be used on the first stage cup, which thereby reduces both the cup's diameter and sidewall thickness. For example, in the field of the manufacture of two-piece metal containers (cans), the container body is typically made by drawing a blank into an intermediate, first stage cup and subjecting the cup to a number of re-drawing operations until arriving at a container body of the desired nominal diameter, then followed by ironing the sidewall to provide the desired sidewall thickness and height.

However, DWI (D&I) and DRD processes employed on a large commercial scale do not act to reduce the thickness (and therefore weight) of material in the base of the cup. In particular, drawing typically does not result in significant reduction in thickness of the object being drawn, and ironing only acts on the sidewalls of the cup. Essentially, for known DWI (D&I) and DRD processes for the manufacture of cups for two-piece containers, the thickness of the base remains relatively unchanged from that of the ingoing gauge of the blank. This can result in the base being far thicker than required for performance purposes.

Food, beverages, and other products are often packaged in two piece cans formed from aluminum, tin-plate steel, or coated steel sheets. Two piece cans include a can body having an integral base and sidewall and a lid that is seamed to the top of the sidewall of the can body.

Tin plate for can making typically is provided under ASTM A623 or ASTM A624 specifications. Even though most commercial tin plate is hot rolled or annealed late in the manufacturing process, often a surface cold rolling process provides an identifiable grain direction. The grains in commercial tin plate for can making are not equiaxed, but rather in a cross sectional sample define a longitudinal direction, which defines the grain direction, and a transverse direction. The grains boundaries are visible upon magnification by widely accepted techniques, such as described in ASTM E 112.

Aluminum for canmaking often begins as a sheet of 3104-H19 or 3004-H19 aluminum alloy, which is aluminum with approximately 1% manganese and 1% magnesium for strength and formability. The cold rolling process used to produce commercial grade aluminum for canmaking yields a metal sheet having non-equiaxed grain structures. In this regard, aluminum sheet grains define a longitudinal direction and a transverse direction. Because of the amount of cold rolling, grains in commercial aluminum sheet for can making are elongated compared to grains in commercial tinplate for canmaking.

There is a need for improved can technology and improved cans that make efficient and effective use of sheet material that takes advantage of economics of metal supply.

SUMMARY

A can body is formed from a process that includes a stretching operation on metal that becomes at least a portion of the base, and then drawing the stretched material radially outward, preferably into the sidewall. Subsequent ironing of the sidewall produces cans having desired base and wall thicknesses from thinner, less expensive sheet metal. In this regard, additional rolling steps need not be performed on the sheet metal at the mill, but the metal can be thinned during the can making process to achieve the desired attributes. Can bodies formed of this method may have attributes that are unlike cans made from less economical, thinner plate. For example, thickness reduction and distribution from raw sheet, hardness increase because of the stretching operation, and micrograin structure change due to stretching may be unique in the base of the can body formed from the disclosed method.

Such a drawn and ironed metal can body that is adapted for seaming onto a can end includes an ironed sidewall and an enclosed, un-domed base integrally formed with the sidewall. The bottom panel of the base (that is, the portion of the base within the peripheral countersink) preferably may have an average Rockwell hardness number that is at least approximately 64. The average is a numeric average of points taken through the center and in the rolling direction. The average Rockwell hardness number may be between 64 and 70. These hardness numbers are based on a process beginning with conventional, continuously annealed T4 plate having a starting hardness of 58. The present invention is not limited, however, to beginning with any particular plate thickness or hardness.

Preferably, the can body sidewall has an average thickness of between about 0.006 inches and 0.015 inches, and the sidewall has a flange capable of being double seamed to a curl of a can end.

According to another embodiment or aspect of the present invention, the can body base may have either (i) a Rockwell hardness that is at least approximately 65 or (ii) an average change in hardness from the raw sheet of at least 5 in Rockwell hardness number or (iii) an average change in Rockwell hardness number from the raw sheet of at least 7%. Preferably, the increase in average Rockwell hardness number is between 5 and 17, and may also be between 6 and 15, or 7 and 12, or 8 and 10. Preferably, the increase in average Rockwell hardness number, regardless of the starting sheet, is between 8% and 21%, and preferably between 10% and 16% or between 12 and 15%. The sidewall of all the cans referred to in the summary section preferably has a thickness between approximately 0.004 and approximately 0.015 inches, and more preferably between approximately 0.004 inches and 0.007 inches.

According to another embodiment or aspect of present invention, the can body base is formed from a sheet that is at least 0.011 inches thick and includes an ironed sidewall and a base integrally formed with the sidewall. The base includes a peripheral countersink and a substantially flat bottom panel having an average thickness between 0.006 and 0.015 inches and an average decrease in thickness from the raw sheet of at least 2%. Preferably the average decrease in thickness from the raw sheet is between 5% and 30%, or between 10% and 25%. Preferably, the average bottom panel thickness is between 0.008 and 0.012 inches, or between 0.008 and 0.010 inches.

According to another embodiment or aspect of present invention, the can body base is un-domed and includes an ironed sidewall and a peripheral countersink and a bottom wall radially within the countersink. Gains in the base tinplate have an average aspect ratio of at least 1.4, preferably between 1.5 and 2.5, or between 1.6 and 2.2, or approximately 1.8. Preferably the average aspect ratio is at least 20% greater than average aspect ratio of raw sheet from which the can body is formed, and preferably between 20% and 100%, between 30% and 70%, or between 40% and 60% regardless of the starting sheet material.

Figure 1:
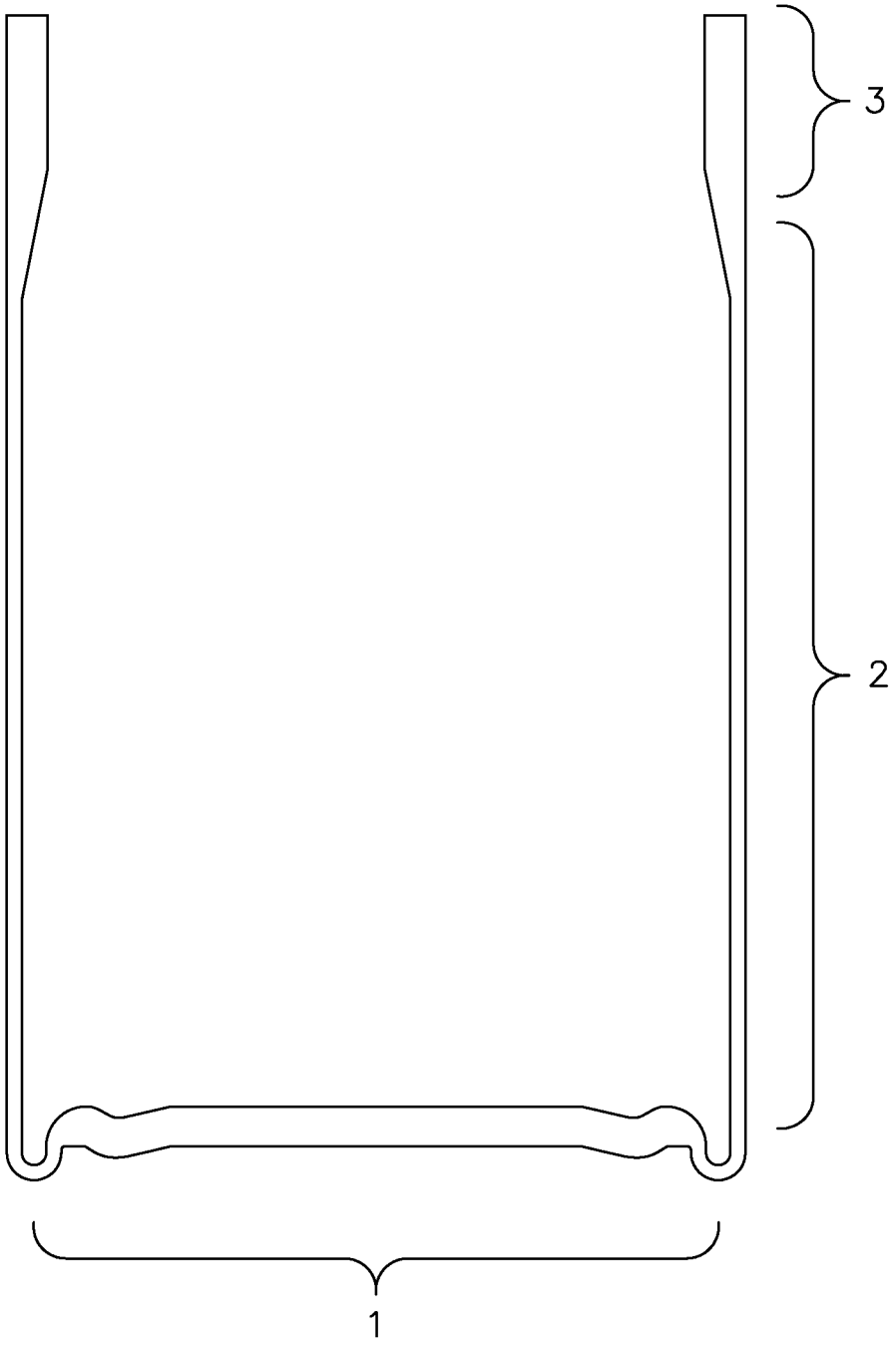
FIG. 1 Prior Art
FIG. 1 is a side elevation view of a container body of the background art resulting from a conventional DWI process. It shows the distribution of material in the base and sidewall regions of the container body.
Figure 2:
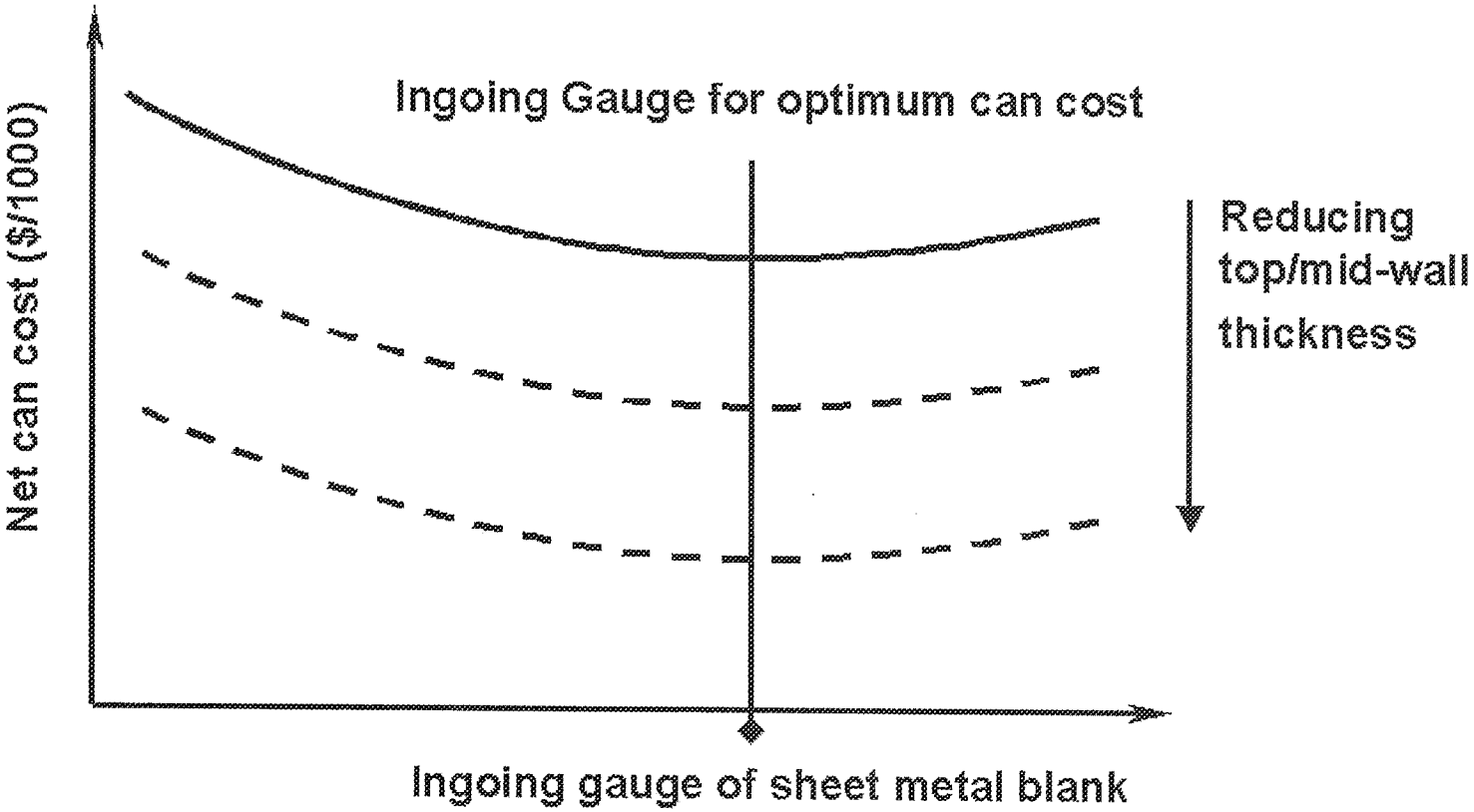
FIG. 2 is a graph showing in general terms how the net overall cost of manufacturing a typical two-piece metal container varies with the ingoing gauge of the sheet metal. The graph shows how reducing the thickness of the sidewall region (e.g. by ironing) has the effect of driving down the net overall cost.
Figure 3:
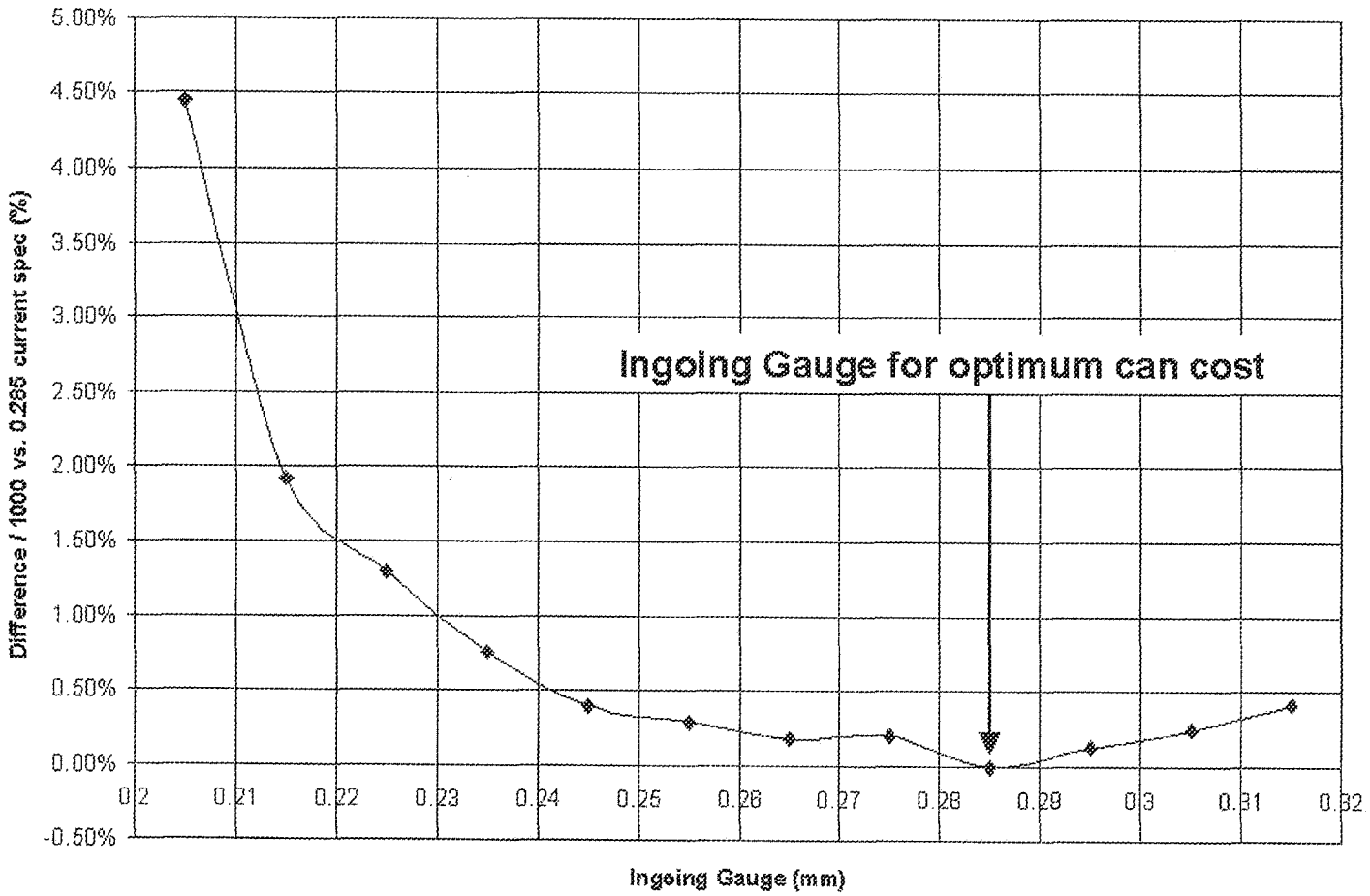
FIG. 3 is a graph corresponding to FIG. 2, but based on actual price data for UK-supplied tinplate.
Figure 4:
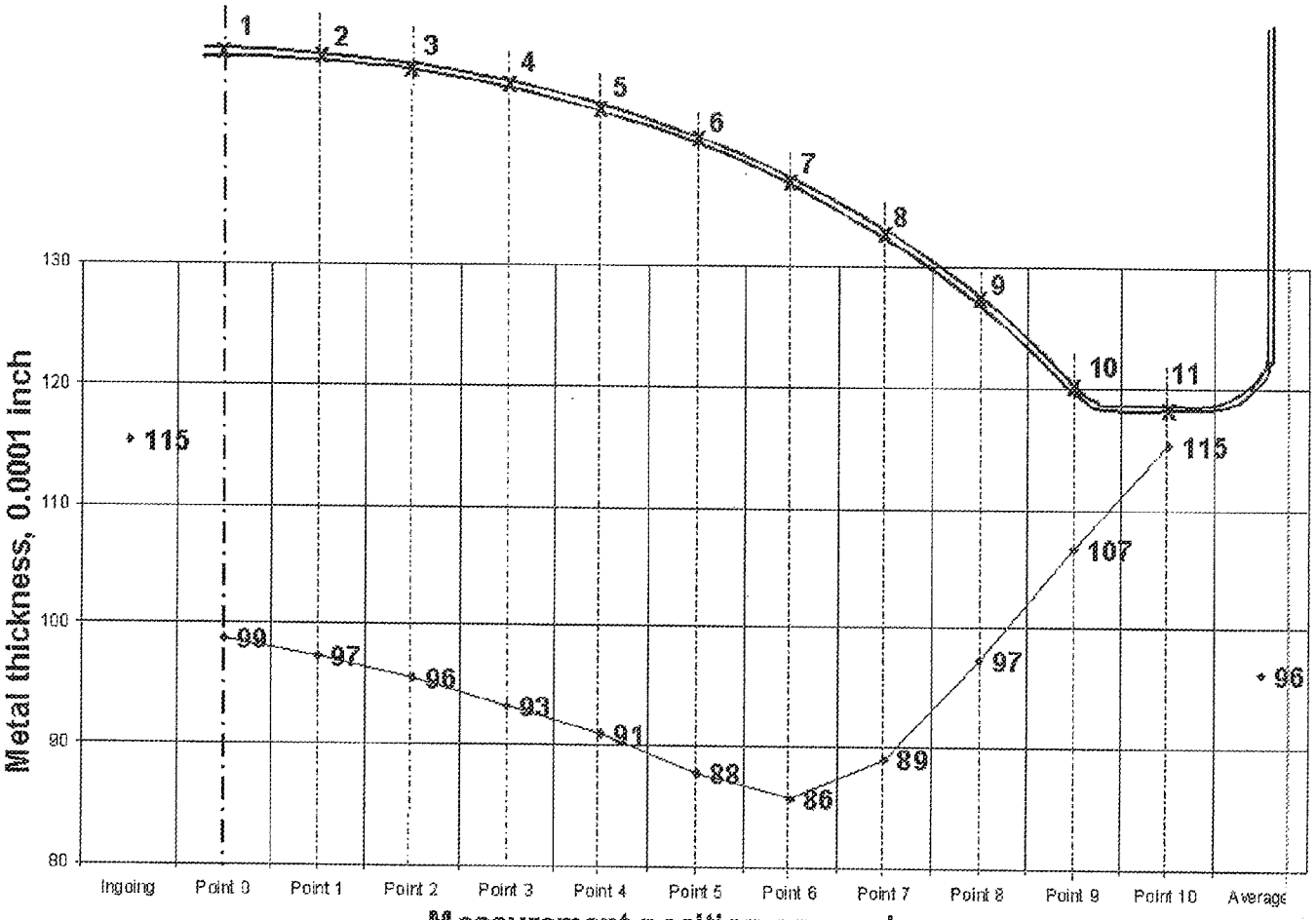

Illustrations of aspects of invention are illustrated in the following drawings, with reference to the accompanying description:

FIG. 4 is a graphical representation of the variation in base thickness of a cup resulting from use of a "stretch" punch (according to the invention) having a domed profiled end face.

Figure 5A:
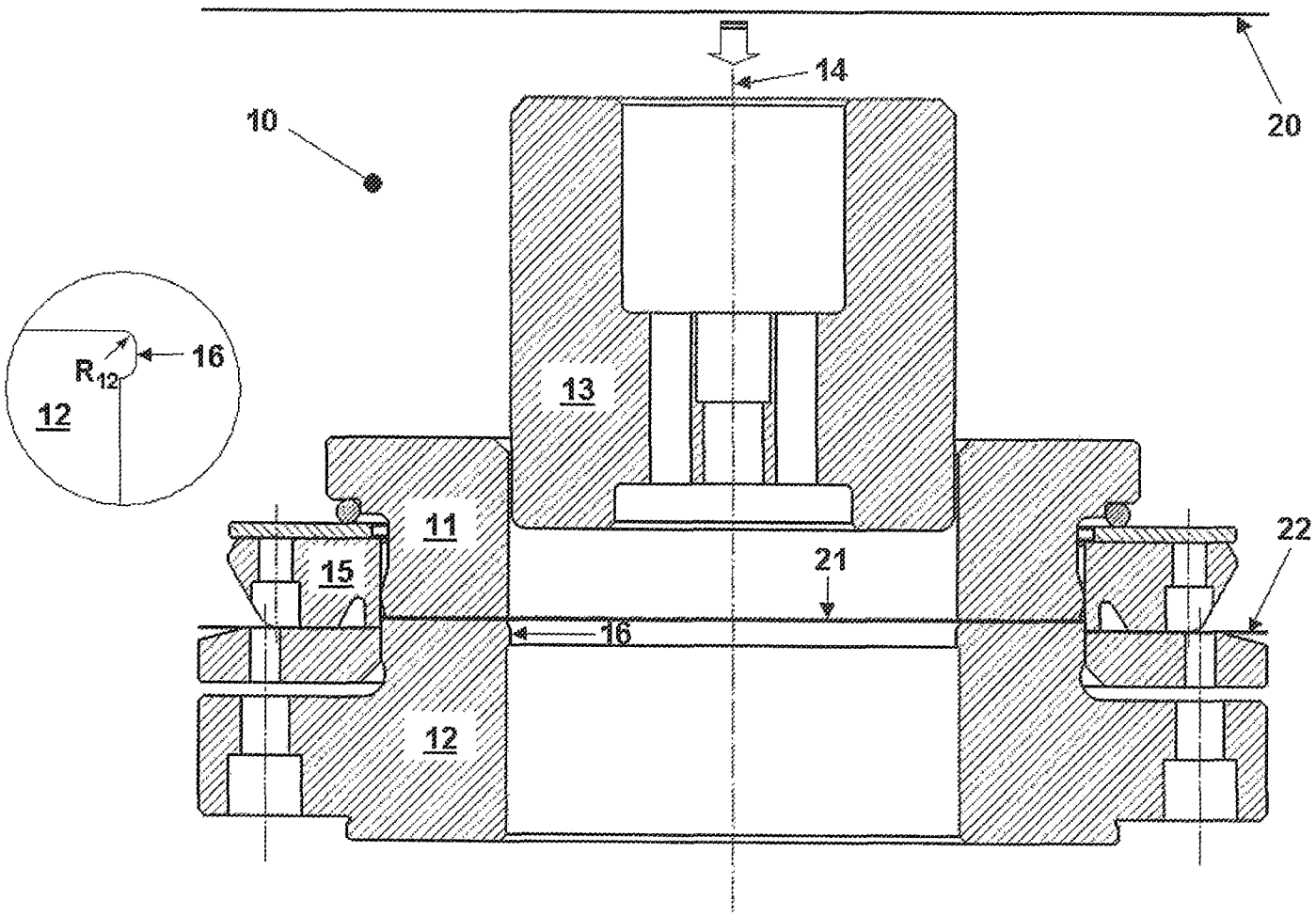

FIG. 5*a* is a side elevation view of the tooling of a cupping press used to form a first stage cup from a sheet metal blank. The figure shows the tooling before the initial drawing operation has commenced.

Figure 5B:
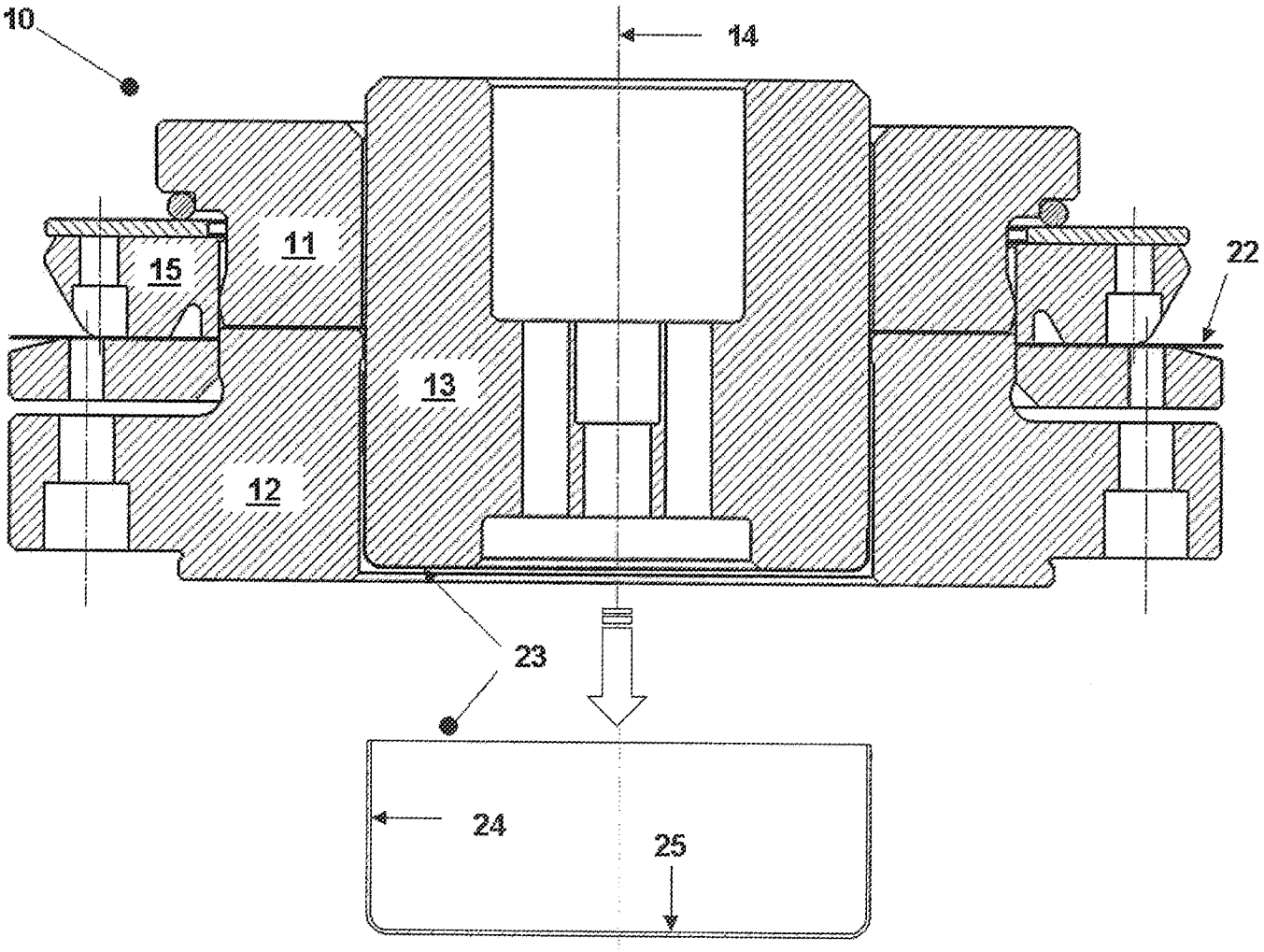

FIG. 5*b* corresponds to FIG. 5*a*, but on completion of the initial drawing operation to form the first stage cup.

Figure 6A:
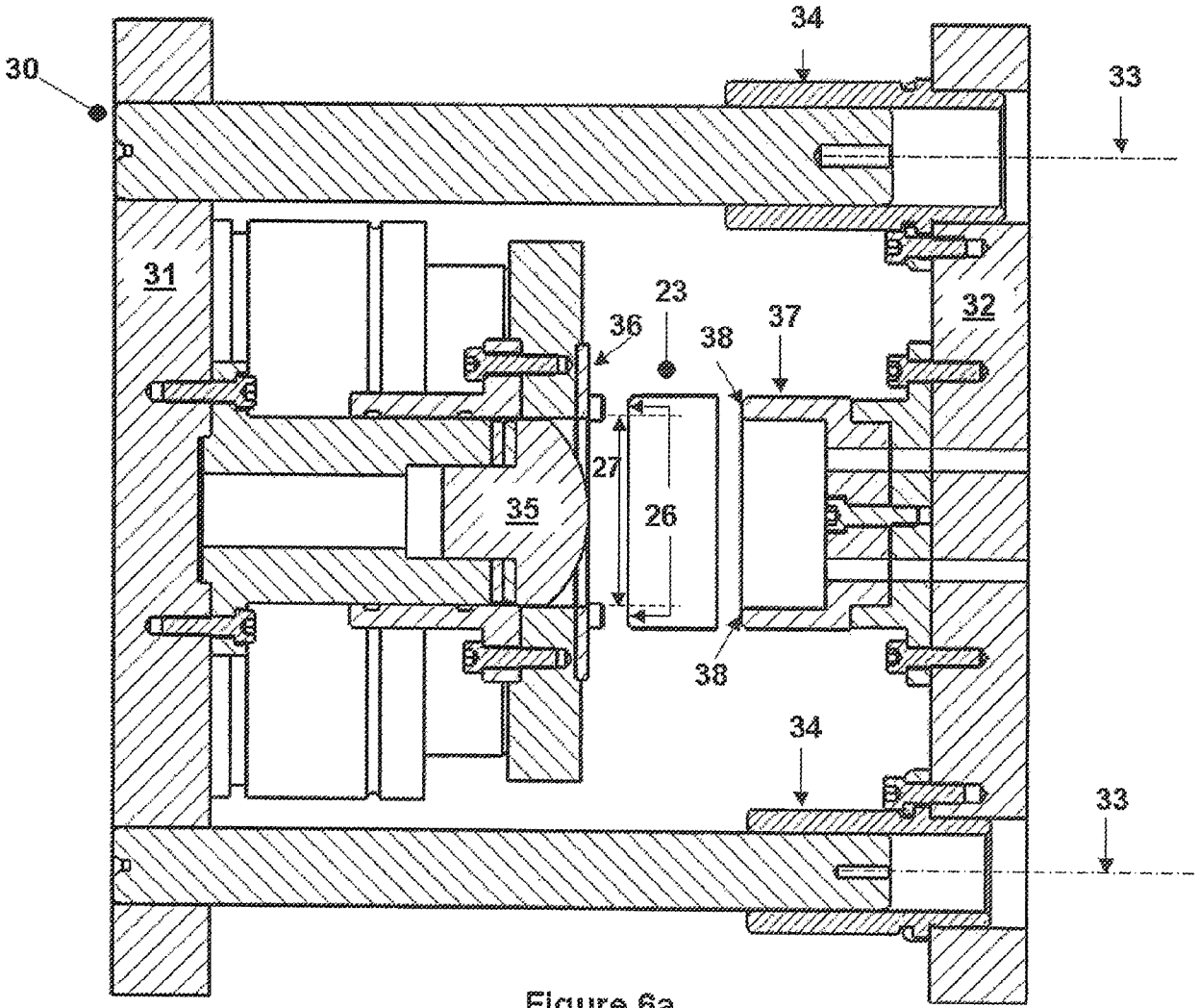

FIG. 6*a* is a side elevation view of a stretch rig used to perform the stretching operation of the invention. The figure shows the stretch rig before the stretching operation has commenced.

Figure 6B:
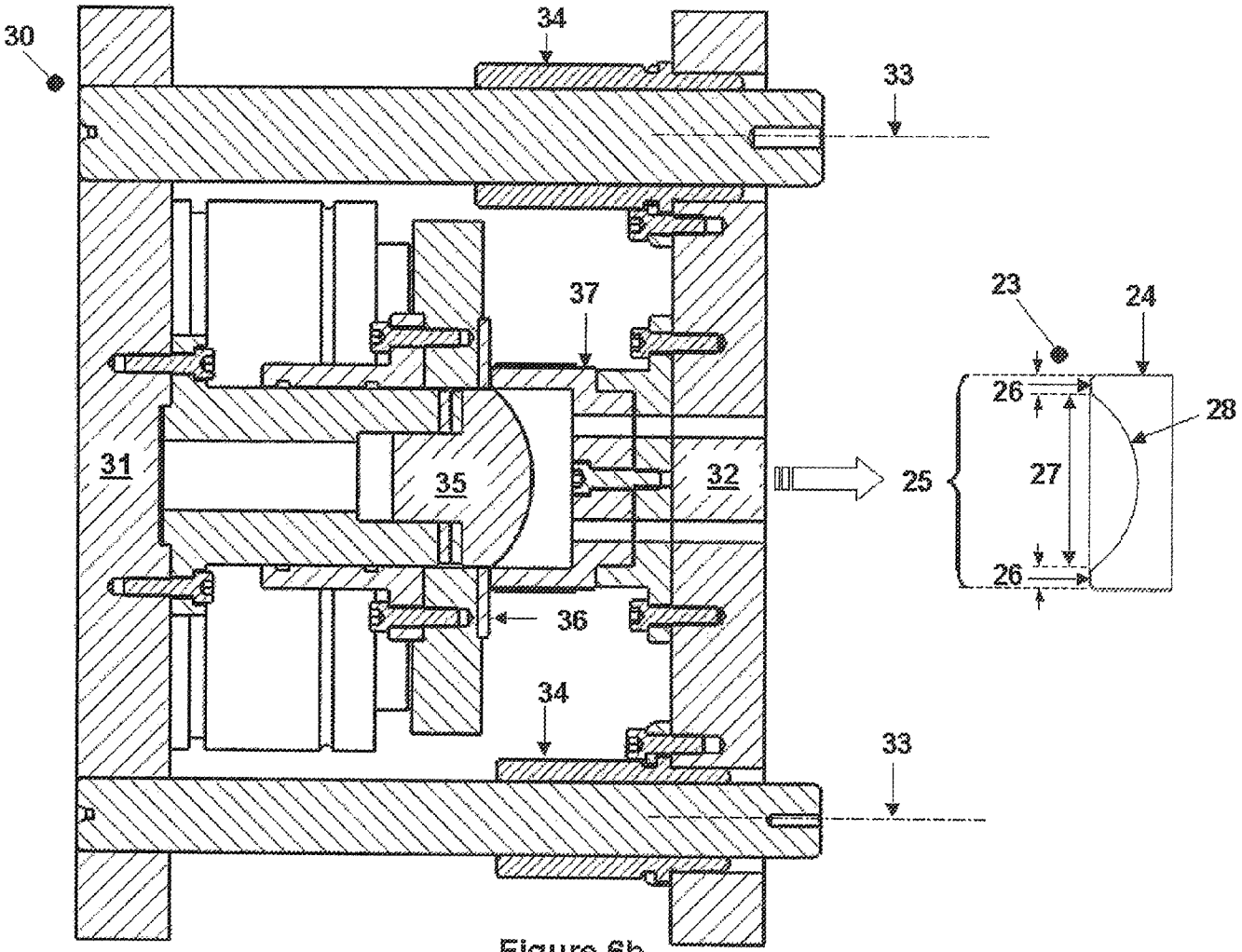

FIG. 6*b* shows the stretch rig of FIG. 6*a*, but on completion of the stretching operation.

Figure 7:
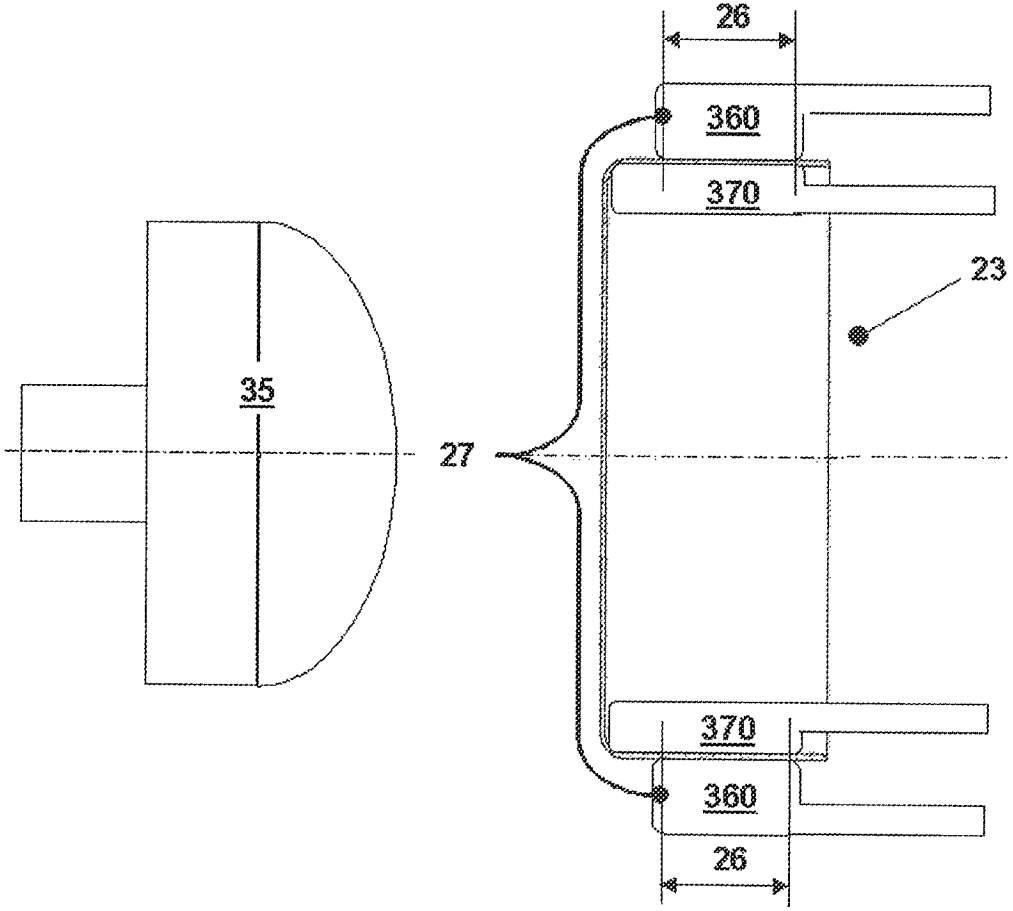

FIG. 7 shows an alternative embodiment to that of FIGS. 6*a* and 6*b*, in which the pre-stretched cup is clamped about its sidewall for the stretching operation.

Figure 8:
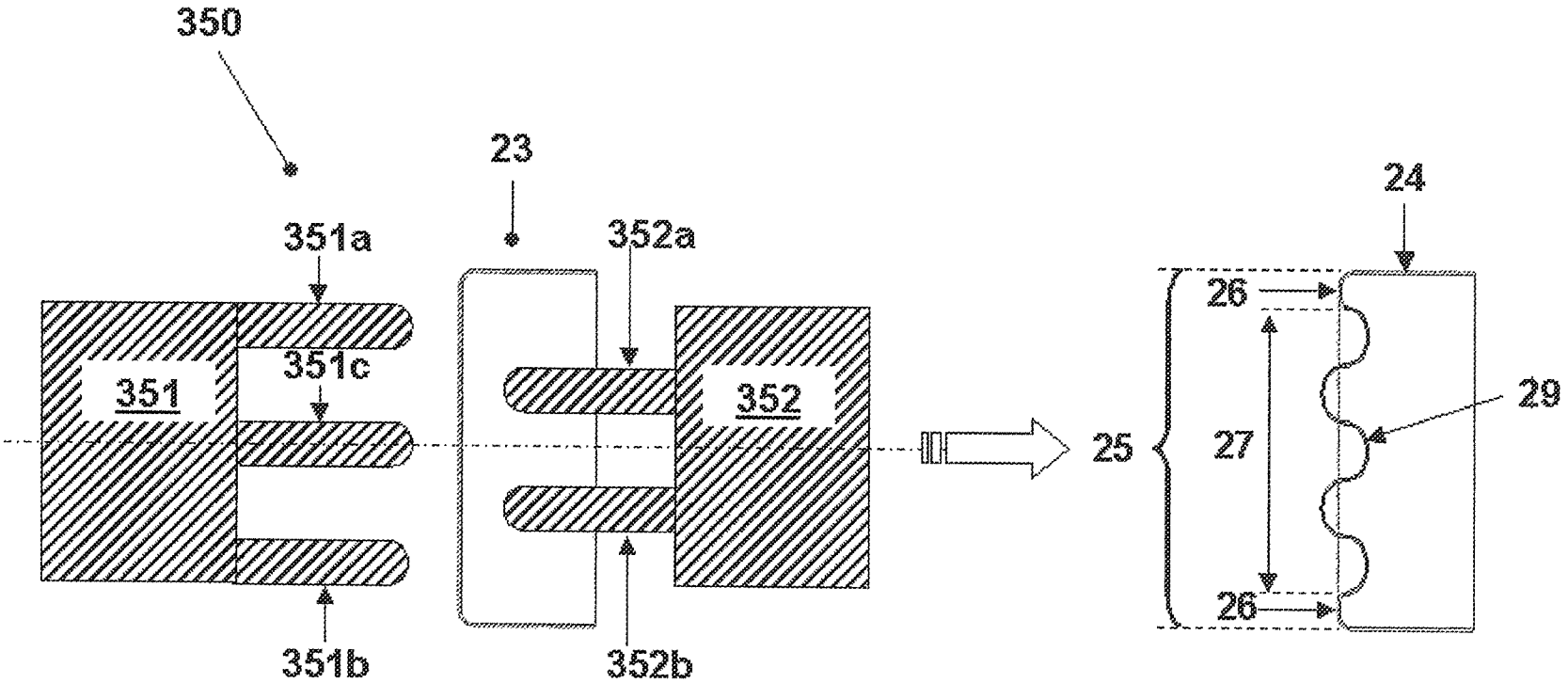

FIG. 8 shows an alternative embodiment of a stretch punch to that shown in FIGS. 6*a* and 6*b*.

Figure 9:
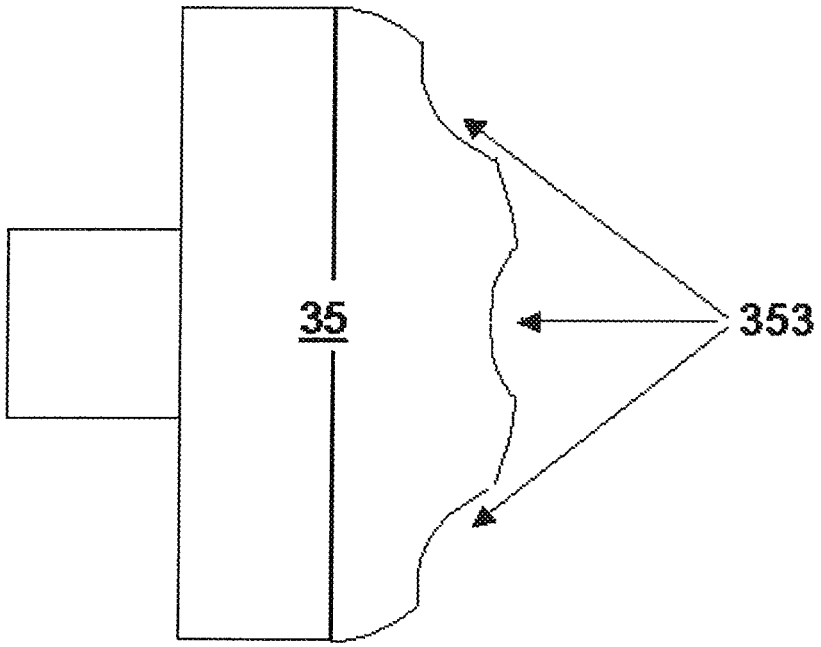

FIG. 9 shows a further alternative embodiment of a stretch punch to those shown in FIGS. 6*a*, 6*b* and 8, where the end face of the a stretch punch includes various relief features.

FIGS. 10*a-d* show perspective views of a bodymaker assembly used to re-draw the stretched cup. The figures show the operation of the bodymaker from start to finish of the stretching operation.

Figure 10A:
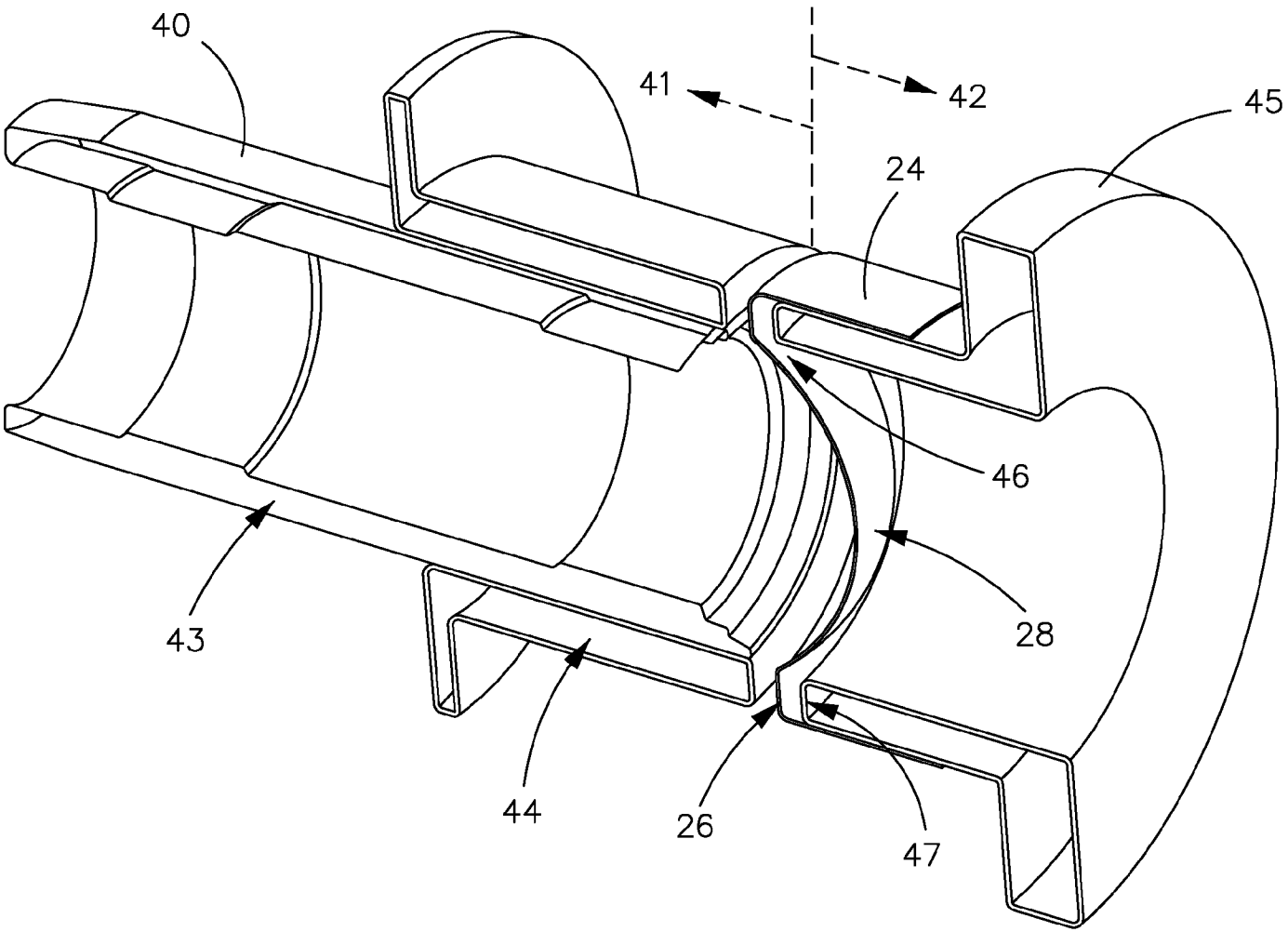
Figure 10B:
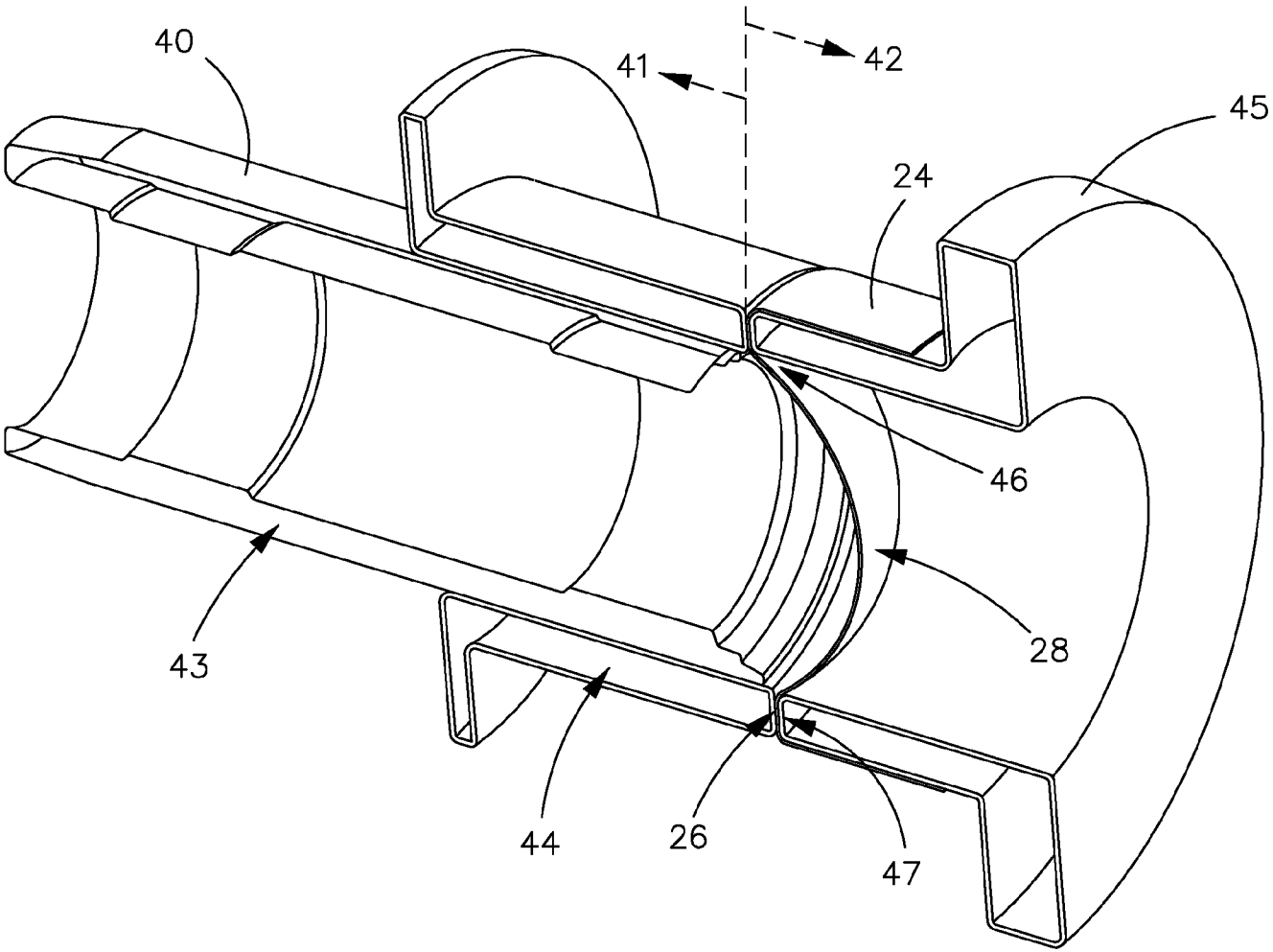
Figure 10C:
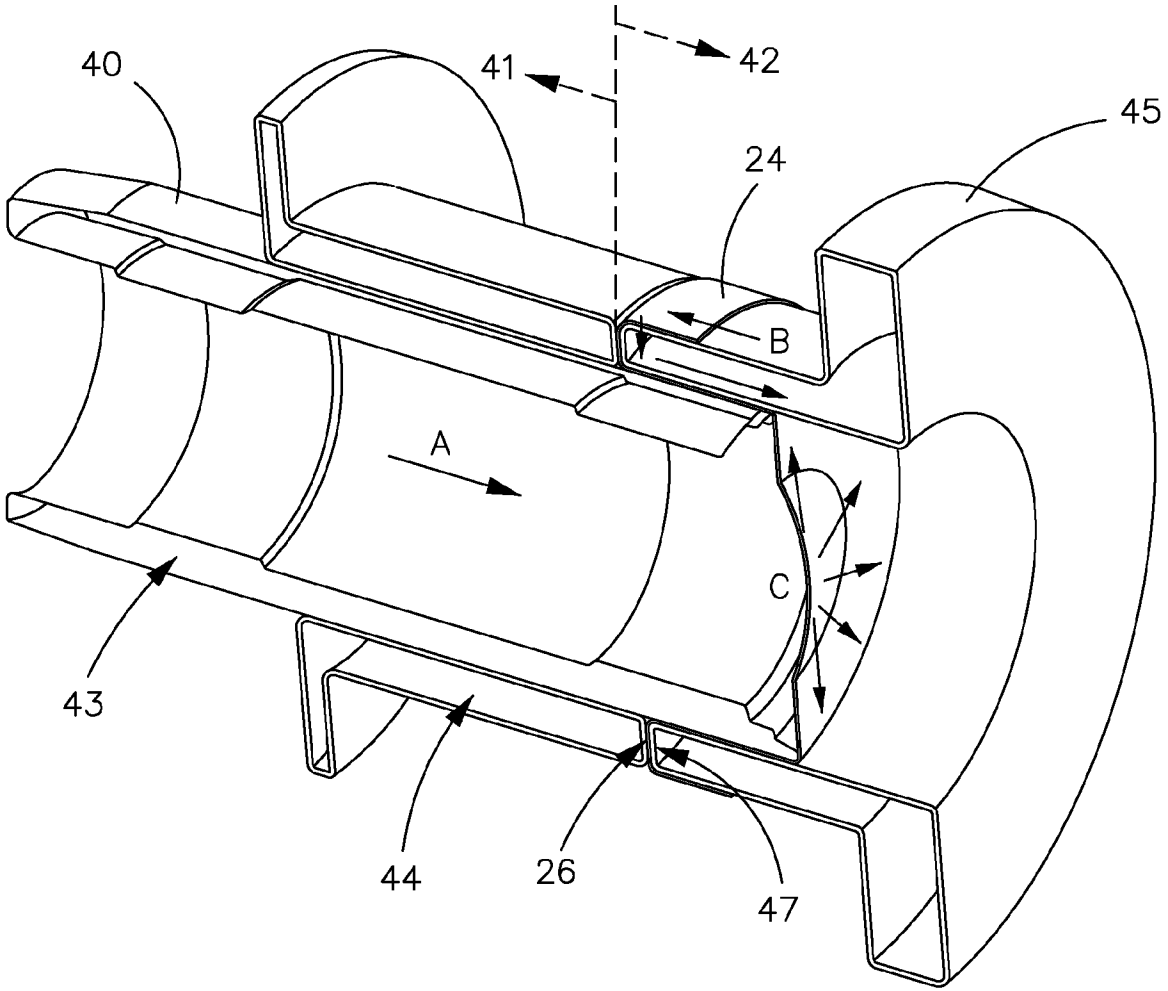
Figure 10D:
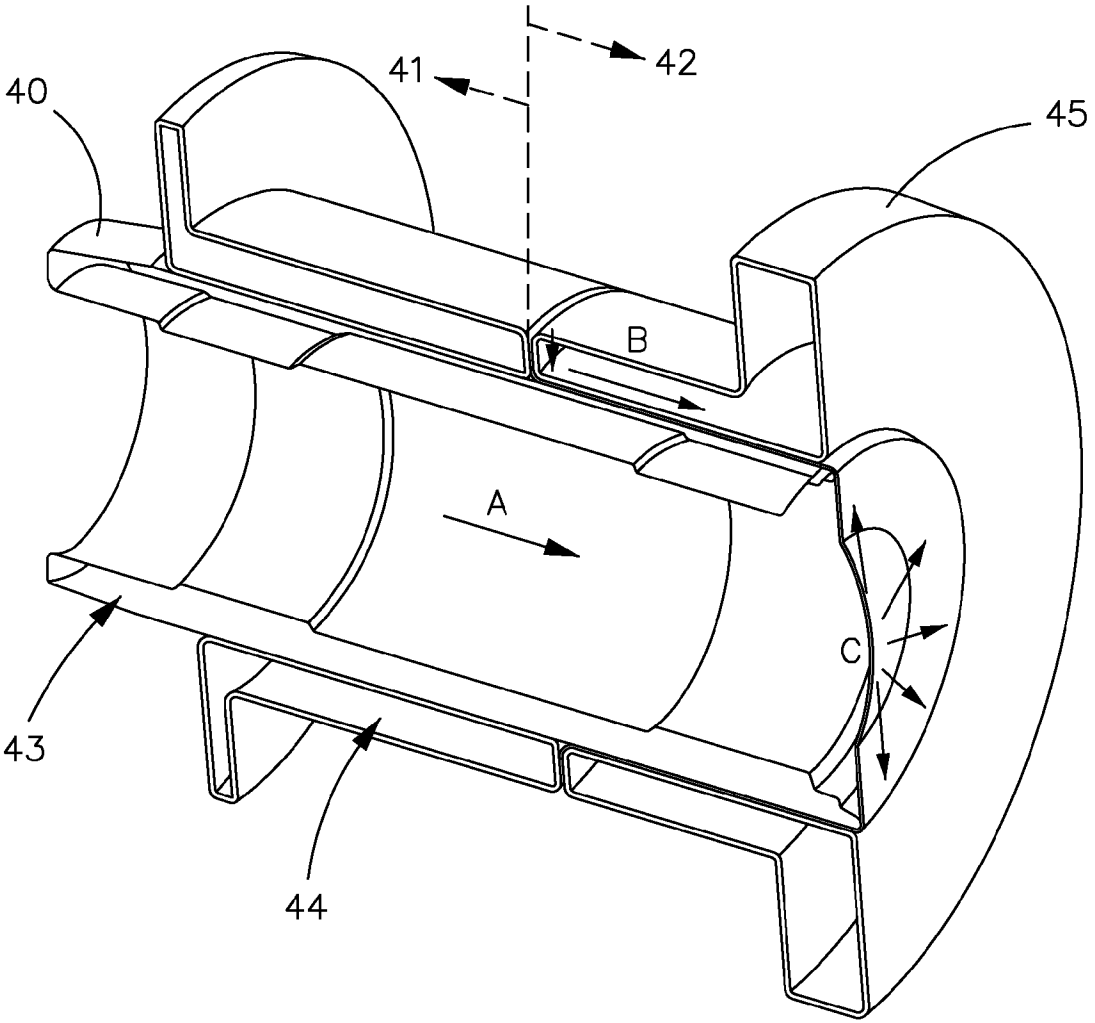
Figure 11:
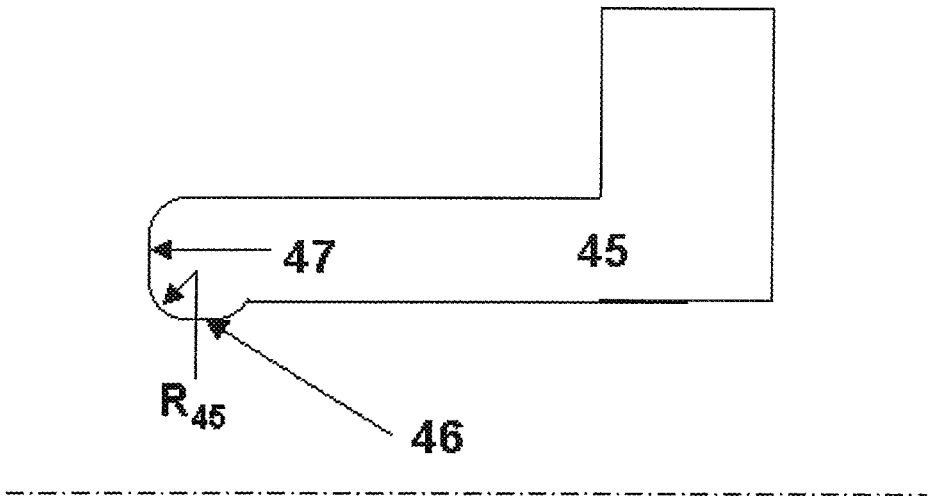

FIG. 11 shows a detail view of the re-draw die used in the bodymaker assembly of FIGS. 10*a-d*.

Figure 12:
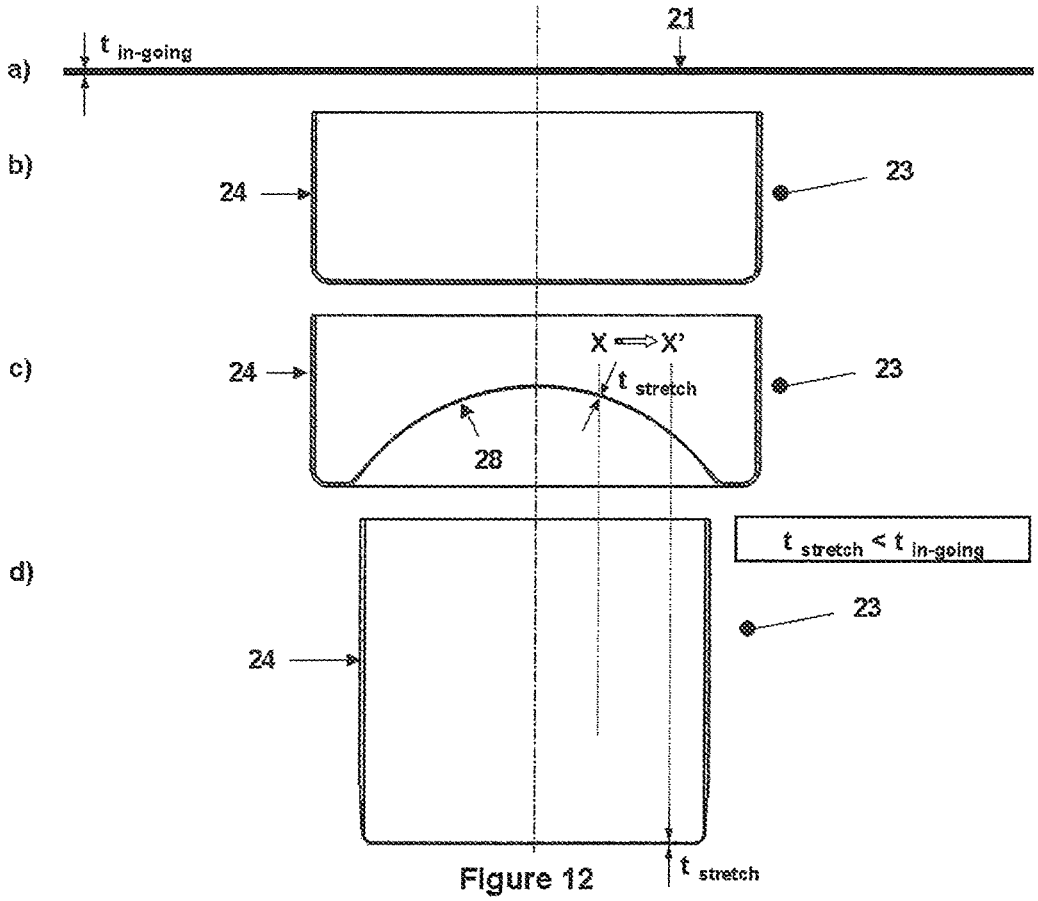

FIG. 12 shows the sheet metal blank at various stages during the method of the invention as it progresses from a planar sheet to a finished cup.

Figure 13A:
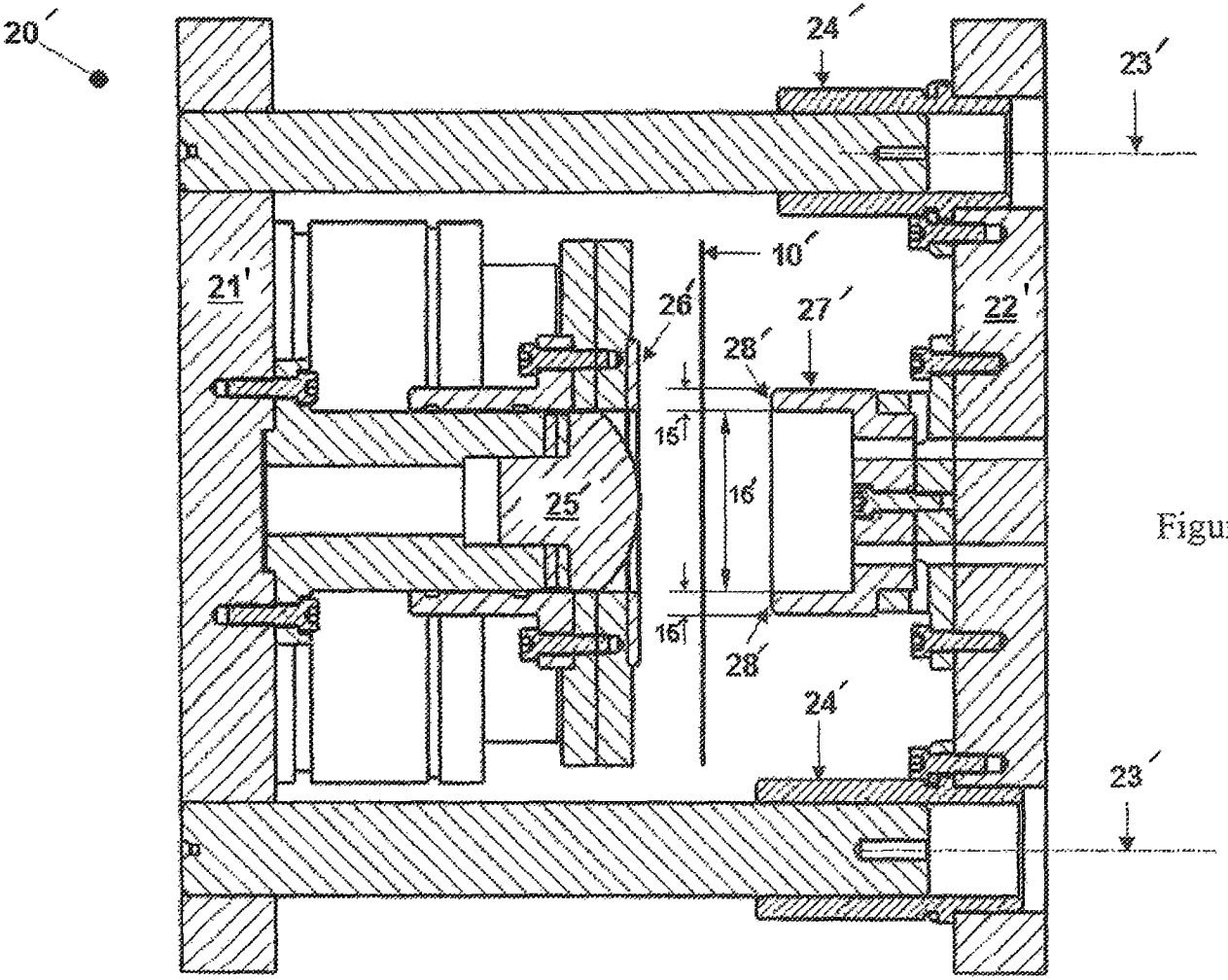

FIG. 13*a* is a side elevation view of a stretch rig used to perform the stretching operation of the invention. The figure shows the stretch rig before the stretching operation has commenced.

Figure 13B:
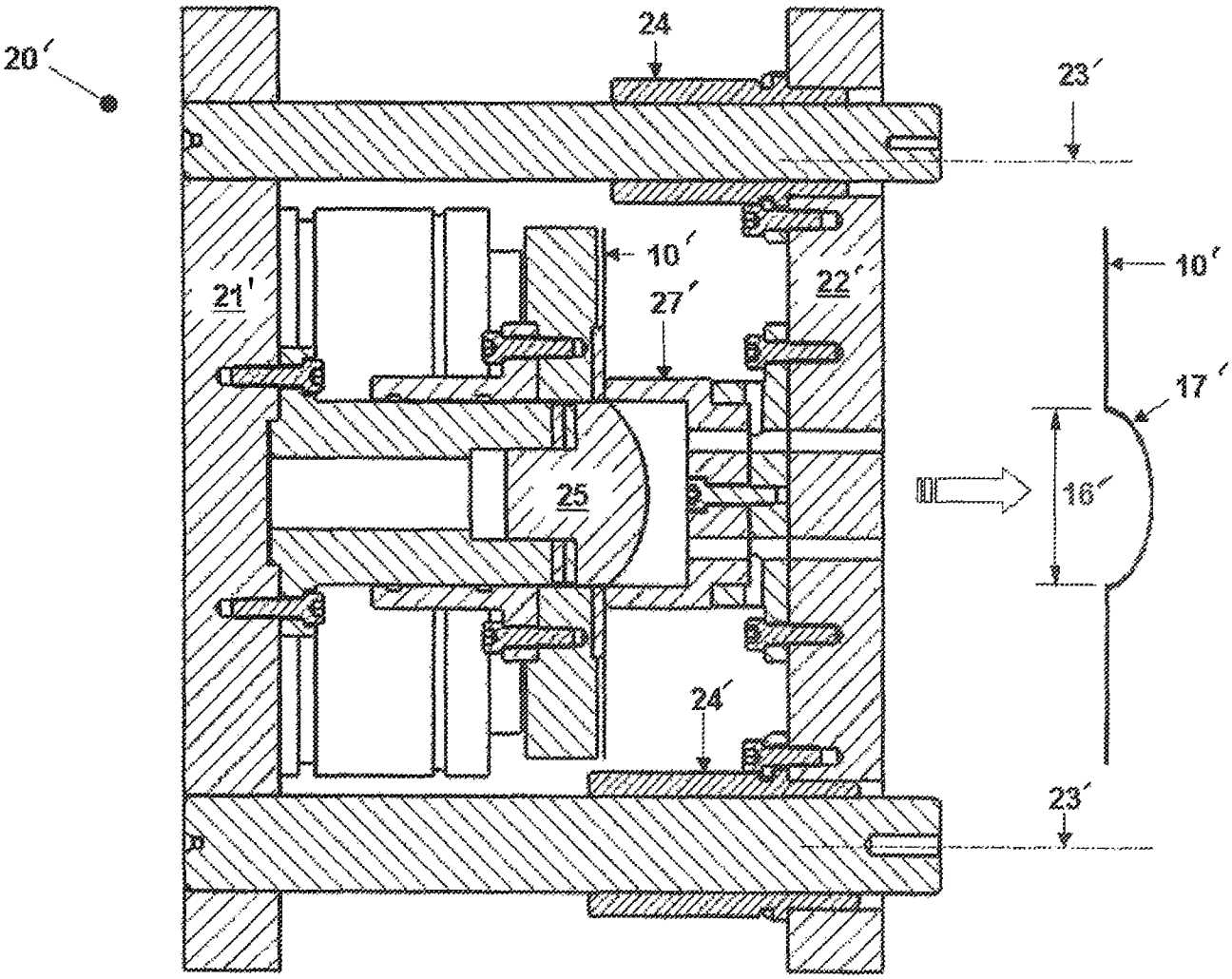

FIG. 13*b* shows the stretch rig of FIG. 13*a*, but on completion of the stretching operation.

Figure 14:
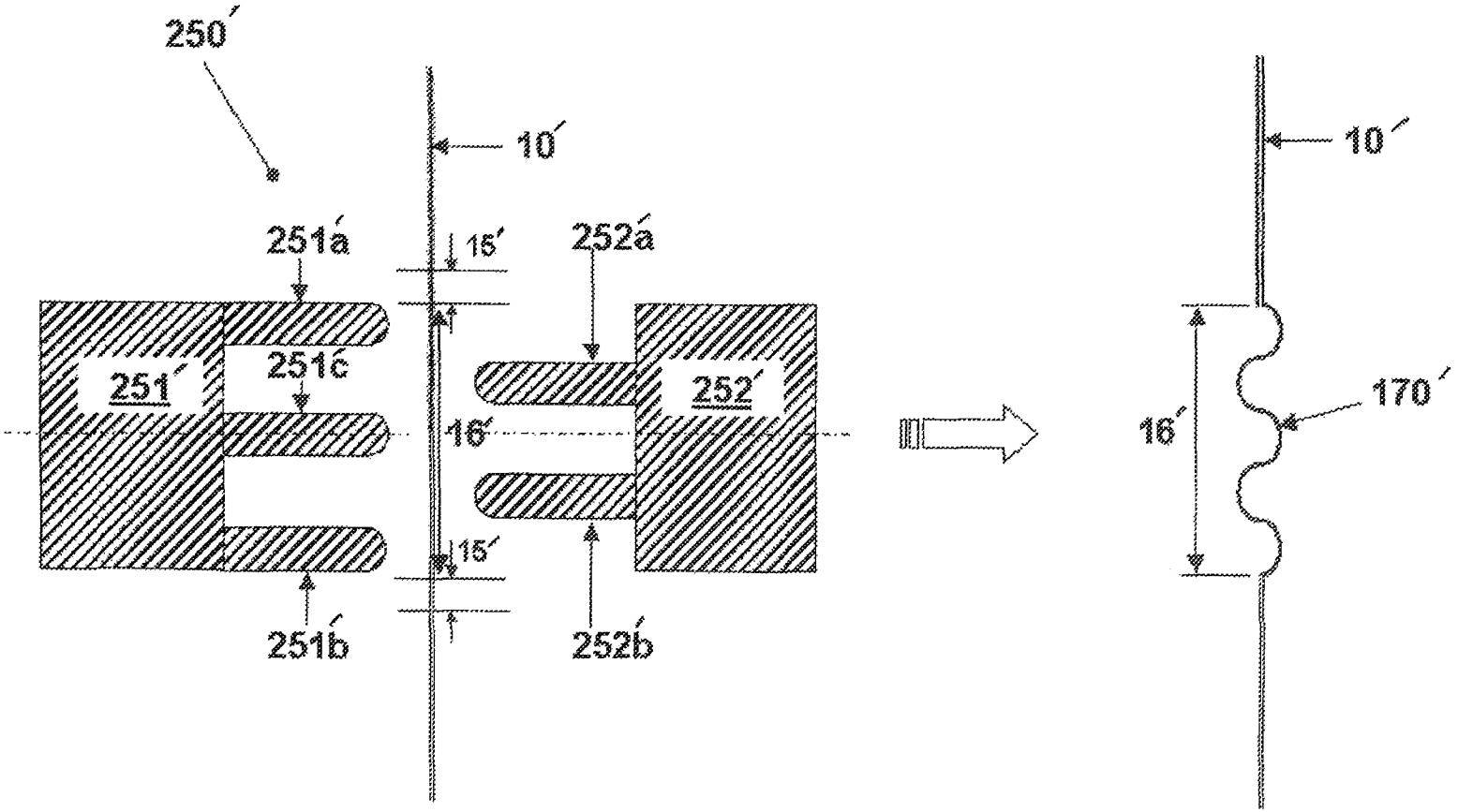

FIG. 14 shows an alternative embodiment of a stretch punch to that shown in FIGS. 13*a* and 13*b*.

Figure 15:
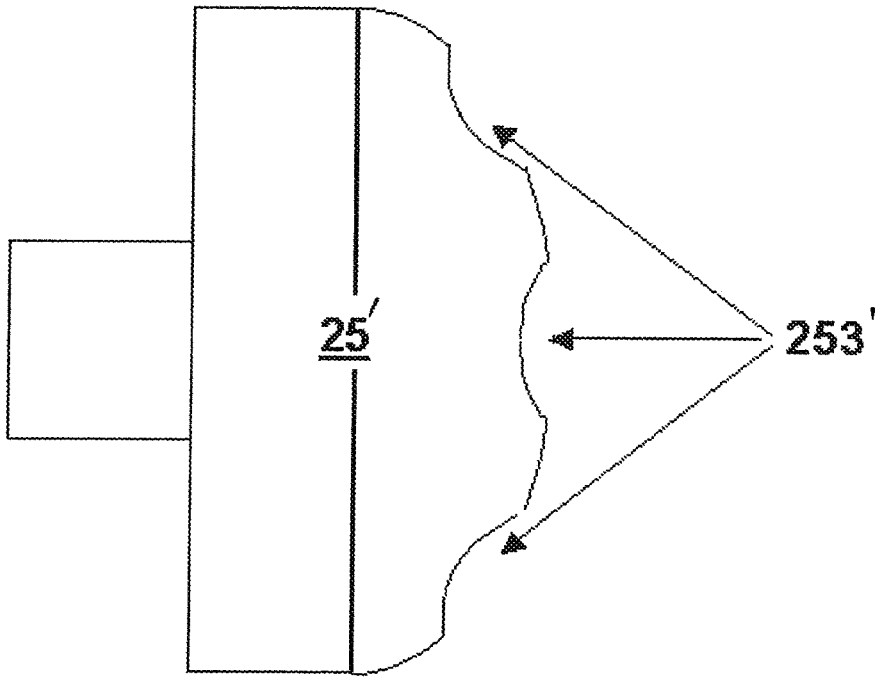

FIG. 15 shows a further alternative embodiment of a stretch punch to that shown in FIGS. 13*a* and 13*b*, where the end face of the stretch punch includes various relief features.

Figure 16:
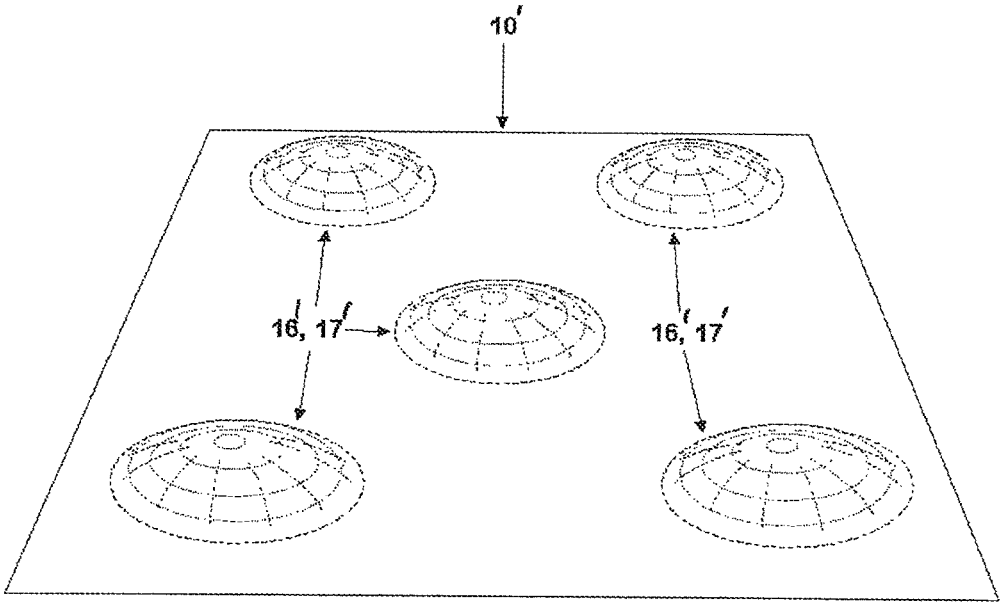

FIG. 16 shows an expanse of metal sheet on which the stretching operation of the invention has been performed on a plurality of "enclosed portions" separated from each other and disposed across the area of the metal sheet.

Figure 17A:
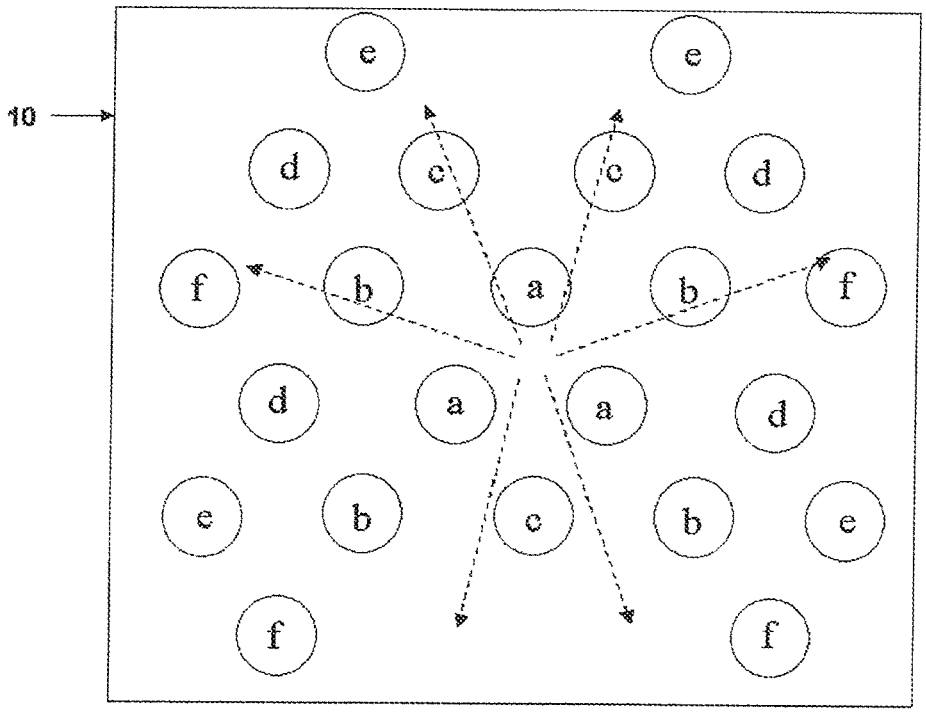
Figure 17B:
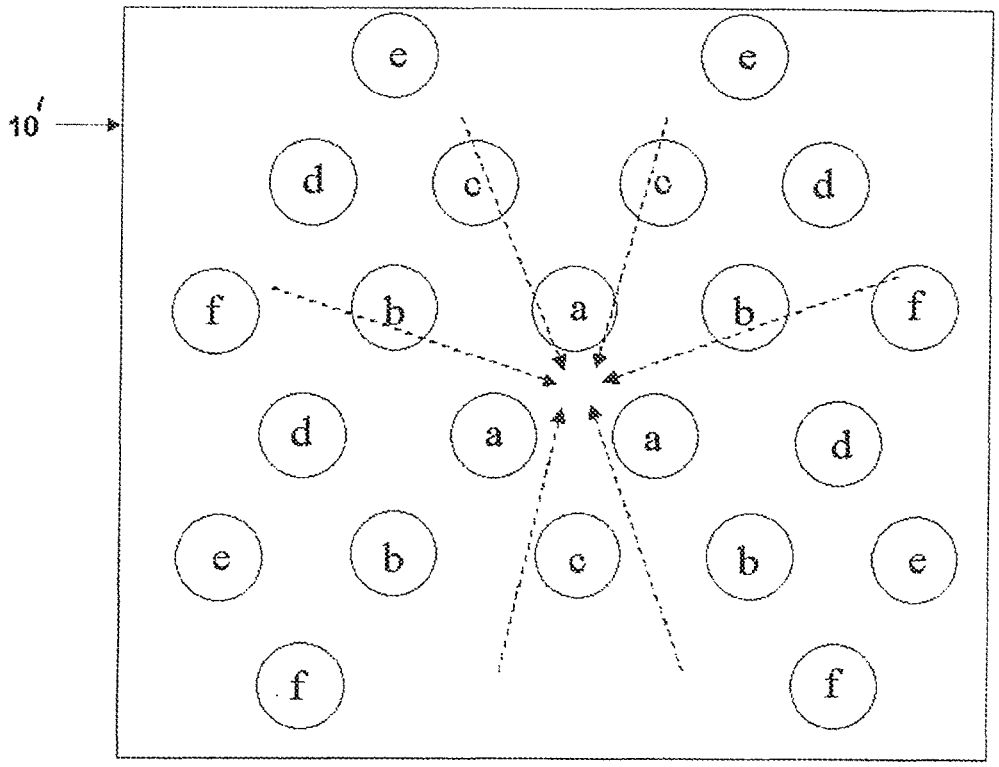

FIGS. 17*a* and 17*b* show how, when performing the stretching operation to provide the stretched sheet shown in FIG. 8, any simultaneous stretching of two or more of the enclosed portions may be staggered to reduce the loads imposed on the tooling used.

Figure 18A:
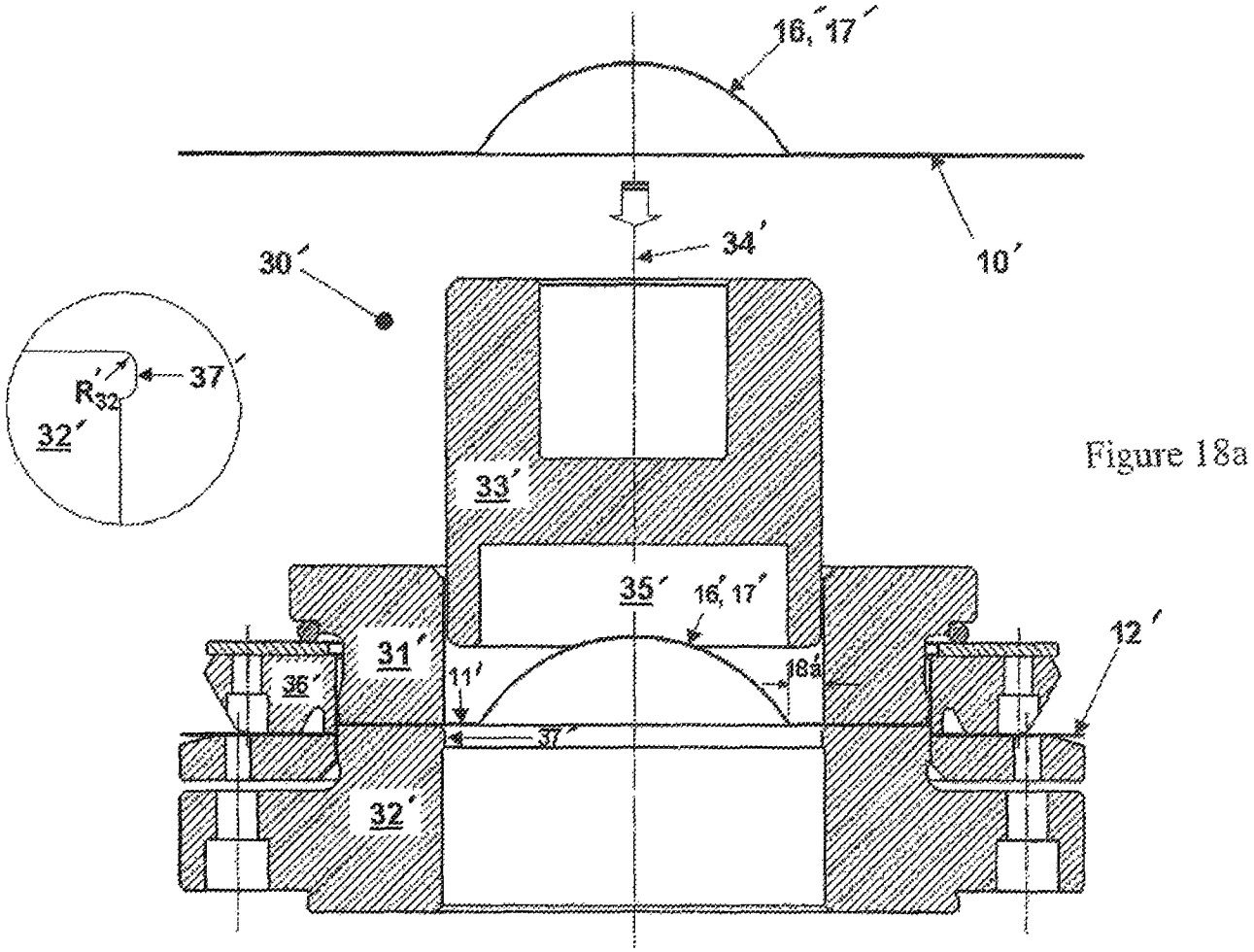

FIG. 18*a* is a side elevation view of the tooling of a cupping press used to perform an initial drawing stage of the drawing operation to form a cup from the stretched sheet metal. The figure shows the tooling before this initial drawing stage has commenced.

Figure 18B:
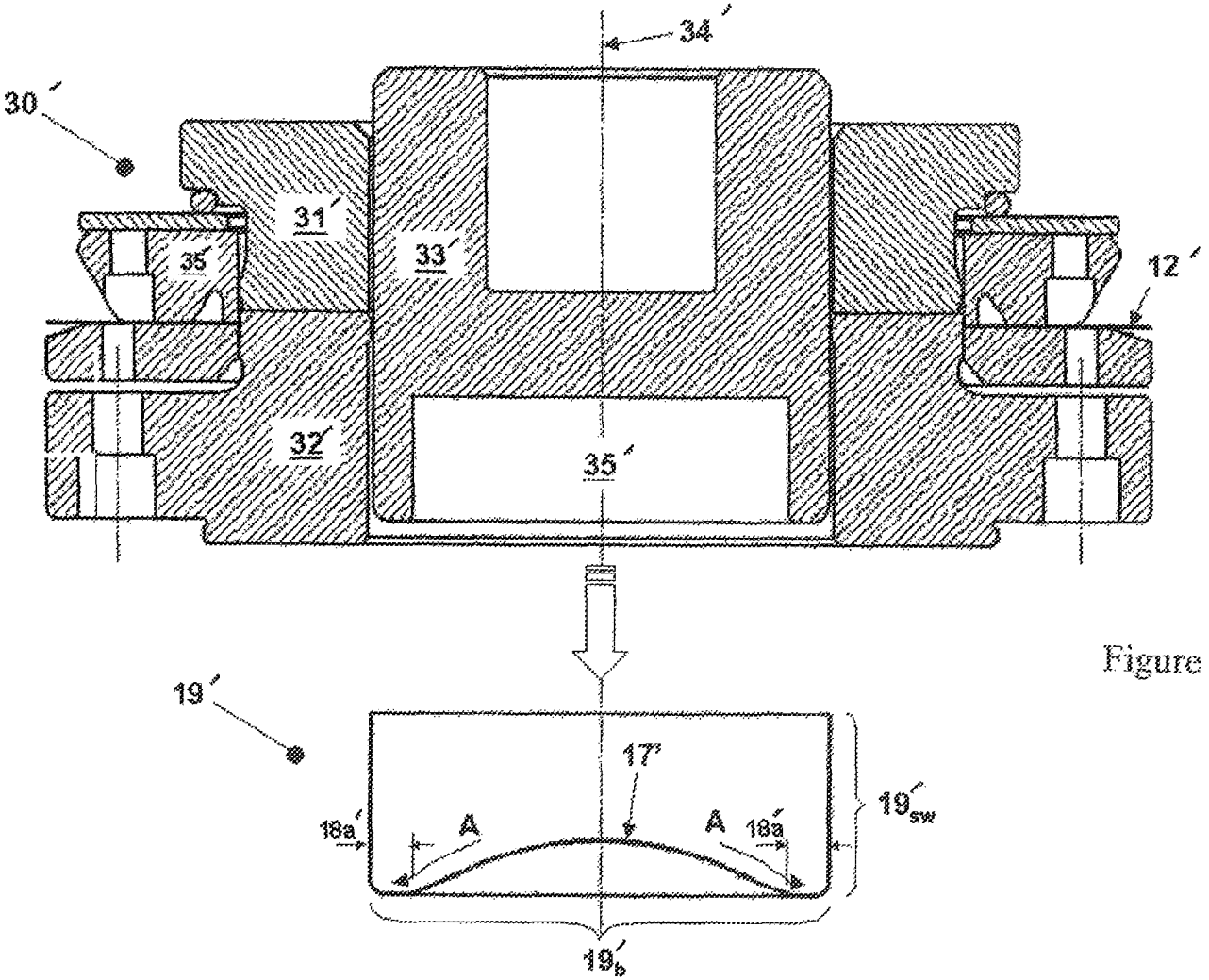

FIG. 18*b* corresponds to FIG. 18*a*, but on completion of the initial drawing stage.

Figure 19:
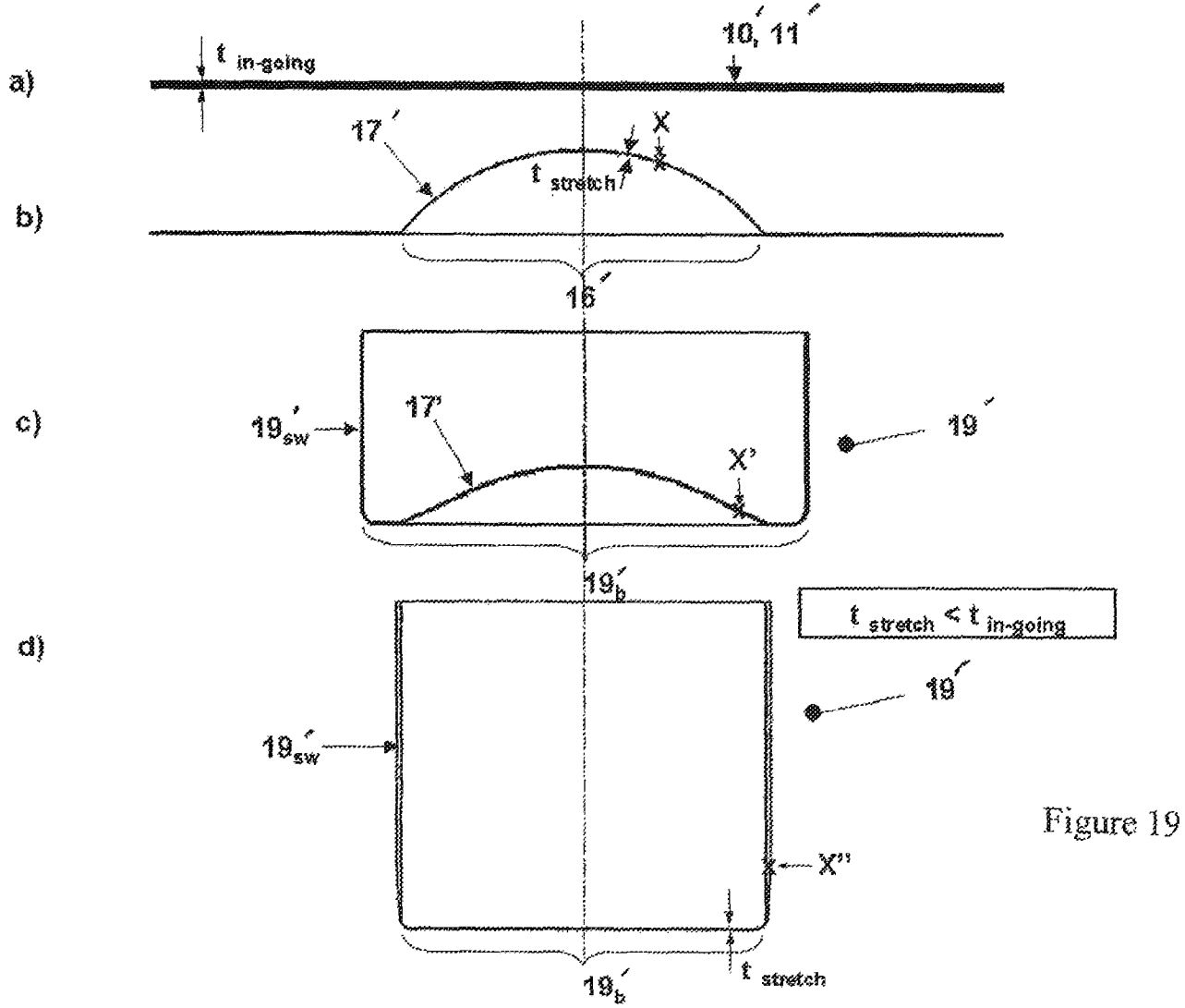

FIG. 19 shows a sheet metal blank at various stages during the method of the invention as it progresses from a planar sheet to a finished cup.

Figure 20:
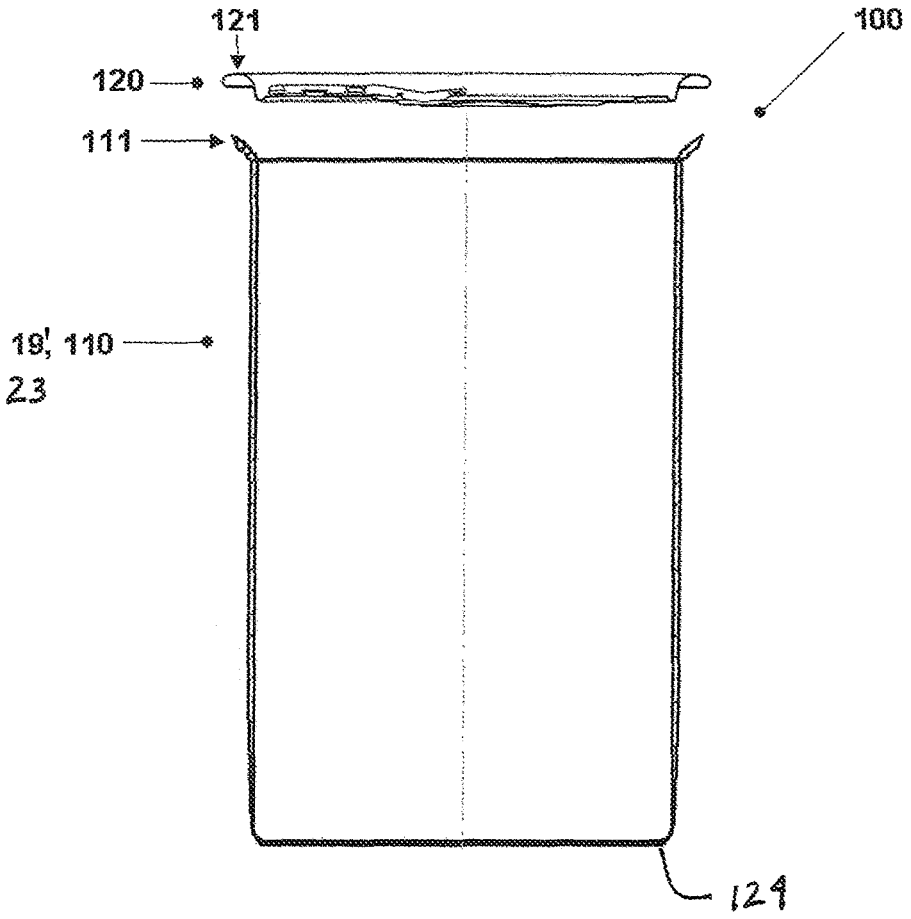

FIG. 20 shows the use of the cup of the invention as part of a two-piece container.

Figure 21:
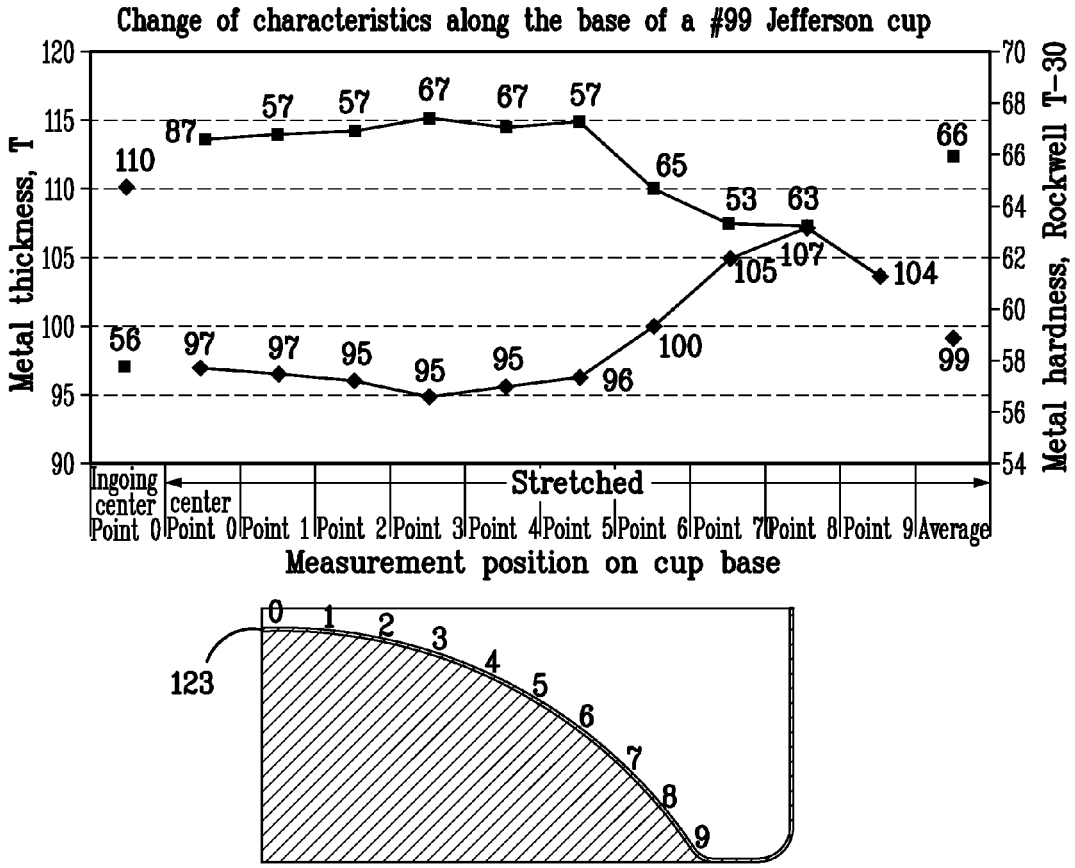

FIG. 21 is graph of hardness and thickness of a cup and an indication of the location of the measurements on the cup, formed according to an aspect of the present invention.

Figure 22:
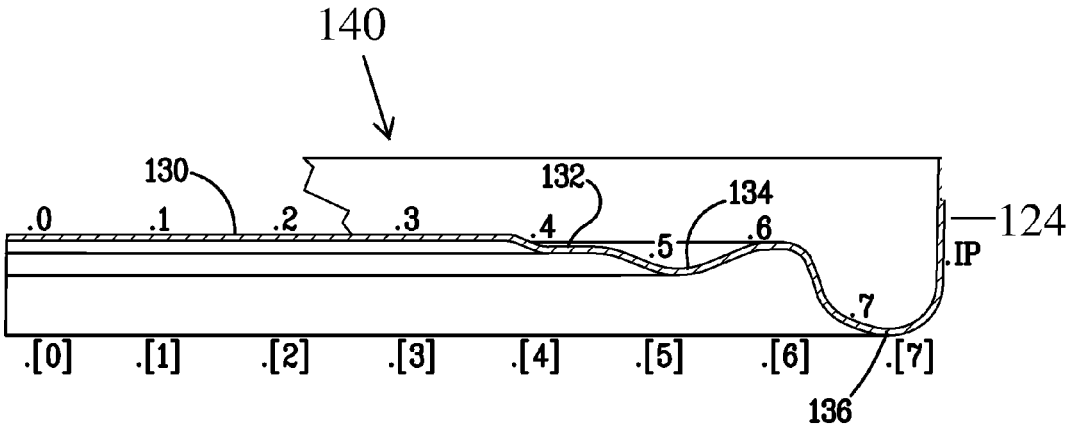

FIG. 22 is a base of a can body formed from the cup shown in FIG. 21, with numbered locations corresponding to the numbered locations shown in the cup of FIG. 21.

Figure 23:
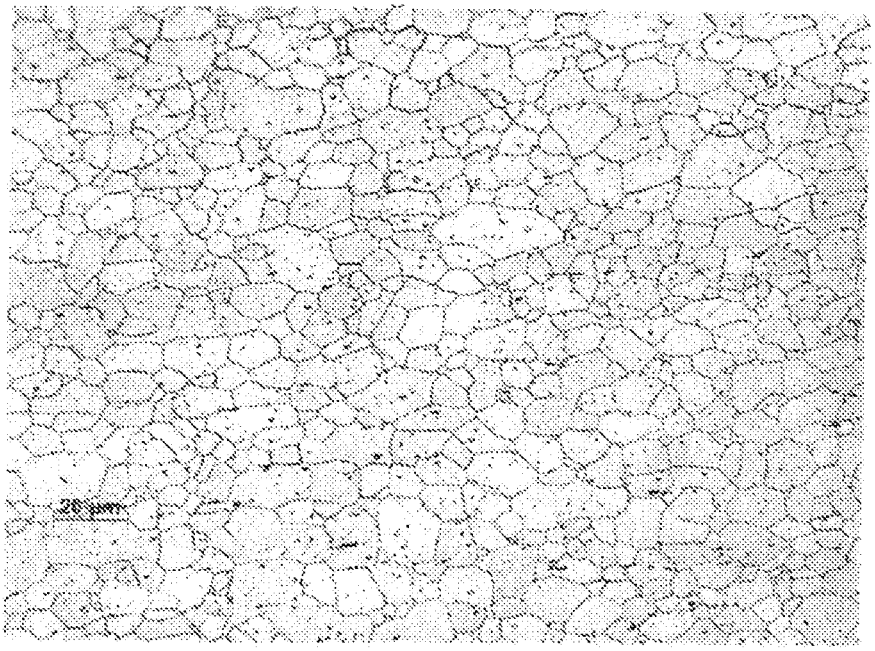
Figure 23 Prior Art

FIG. 23 is a micrograph of grain structure of a conventional cup and can body base.

Figure 24:
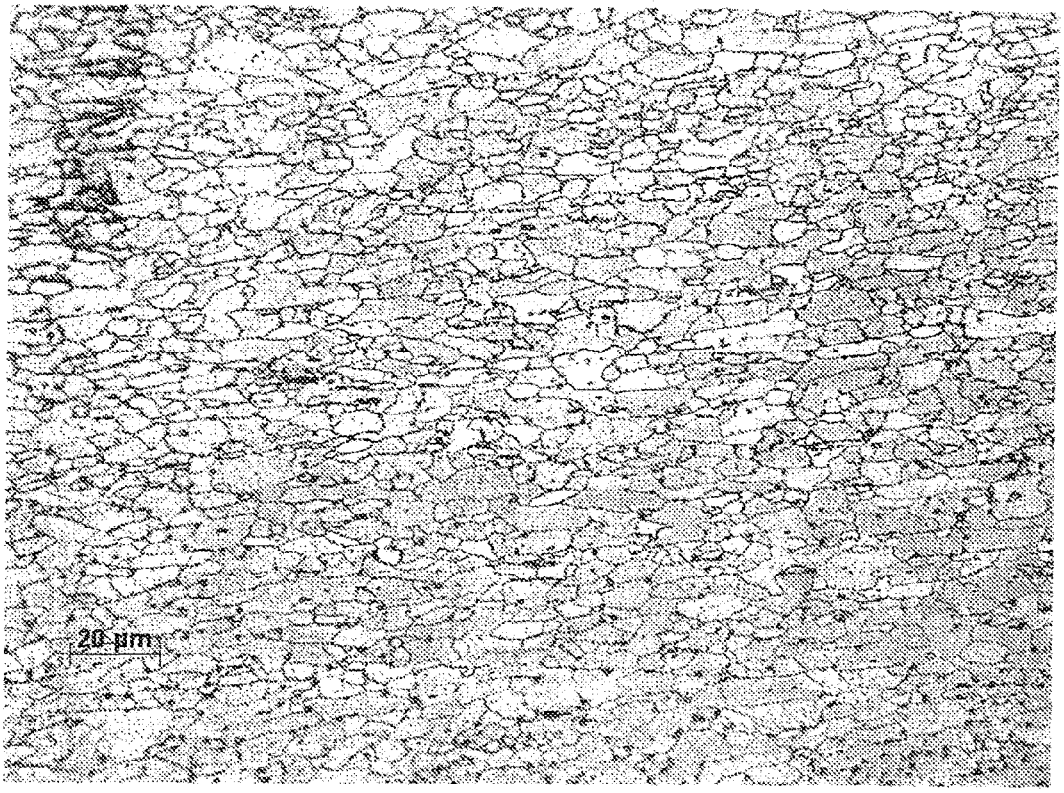

FIG. 24 is a micrograph of grain structure of a cup and can body base formed according to the present invention.

DETAILED DESCRIPTION OF ILLUSTRATIVE EMBODIMENTS

The following describes two example methods of forming a cup from which a can body according to the present invention may be formed, as well as the cup and can body. In the first method, a stretching operation is performed on a drawn cup, followed by redrawing operation. In the second method, a stretching operation is performed on a flat blank, followed by drawing operation. Preferably, a cup formed by either method is wall ironed into a finished can body. The present can body or finished can invention is not limited to the particular steps described below. Rather, the steps of producing the can structure are described to illustrate possible ways to achieve the attributes of the cup or can body. According to a first method of forming an intermediate cup, a cupping press 10 has a draw pad 11 and a draw die 12 (see FIGS. 5*a* and 5*b*). A draw punch 13 is co-axial with the draw die 12, as indicated by common axis 14. A circumferential cutting element 15 surrounds the draw pad 11.

In use, a flat section of metal sheet 20 is held in position between opposing surfaces of the draw pad 11 and the draw die 12. Steel tin-plate (Temper 4) with an ingoing gauge thickness (t in-going) of 0.280 mm has been used for the metal sheet 20. However, the invention is not limited to particular gauges or metals. The section of metal sheet 20 is typically cut from a roll of metal sheet (not shown). After the section of metal sheet 20 has been positioned, the circumferential cutting element 15 is moved downwards to cut a circular planar blank 21 out from the metal sheet (see FIG. 5*a*). The excess material is indicated by 22 on FIG. 5*a*.

After the blank 21 has been cut from the sheet 20, the draw punch 13 is moved axially downwards through the draw die 12 to progressively draw the planar blank against the forming surface 16 of the draw die into the profile of a cup 23 having a sidewall 24 and integral base 25. This drawing operation is shown in FIG. 5*b*, and includes a separate view of the drawn cup 23 when removed from the press 10. A detail view is included in FIG. 5*a* of the radius R12 at the junction between the end face of the draw die 12 and its forming surface 16. As for conventional drawing operations, the radius R12 and the load applied by the draw pad 11 to the periphery of the blank 21 are selected to permit the blank to slide radially inwards between the opposing surfaces of the draw pad 11 and draw die 12 and along forming surface 16 as the draw punch 13 moves progressively downwards to draw the blank into the cup 23. This ensures that the blank 21 is predominantly drawn, rather than stretched (thinned) (or worse, torn about the junction between the end face of the draw die and the forming surface). Dependent on the size of radius R12 and, to a lesser extent, the severity of the clamping load applied by the draw pad 11, the wall thickness of the cup 23 will be essentially unchanged from that of the ingoing gauge of the blank 21, i.e. negligible stretching or thinning should occur. However, in alternative embodiments of the invention, it is permissible for the load applied by the draw pad 11 to be sufficient that a combination of drawing and stretching occurs under the action of the draw punch 13. The cup 23 that results from this initial drawing operation is also referred to the "first stage cup".

Stretching Operation, First Illustrative Method

Following the initial drawing operation shown in FIGS. 5*a* and 5*b*, the drawn cup 23 is transferred to a stretch rig 30, an example of which is illustrated in FIGS. 6*a* and 6*b*. The stretch rig 30 has two platens 31, 32 that are moveable relative to each other along parallel axes 33 under the action of loads applied through cylinders 34 (see FIGS. 6*a* and 6*b*). The loads may be applied by any conventional means, e.g. pneumatically, hydraulically or through high-pressure nitrogen cylinders.

On platen 31 is mounted a stretch punch 35 and a clamping element in the form of an annular clamp ring 36. The annular clamp ring 36 is located radially outward of the stretch punch 35. The stretch punch 35 is provided with a domed end face (see FIGS. 6*a* and 6*b*).

On platen 32 is mounted a cup holder 37. The cup holder 37 is a tubular insert having an annular end face 38 and an outer diameter corresponding to the internal diameter of the drawn cup 23 (see FIGS. 6*a* and 6*b*). In use, the drawn cup 23 is mounted on the cup holder 37 so that the annular end face 38 contacts a corresponding annular region 26 of the cup's base 25 (see FIGS. 6*a* and 6*b*). Loads are applied via cylinders 34 to move platens 31, 32 towards each other along axes 33 until the annular region 26 is clamped firmly in an annular manner between the planar surface of the clamp ring 36 and the annular end face 38 of the cup holder 37. The clamped annular region 26 defines an enclosed portion 27 of the cup. In the embodiment shown in FIGS. 6*a* and 6*b*, the annular clamping thereby separates the base 25 into two discrete regions: the clamped annular region 26 and the enclosed portion 27.

The stretch punch 35 is then moved axially through the clamp ring 36 to progressively deform and stretch (thin) the enclosed portion 27 into a domed profile 28.

In the embodiment shown in the drawings, the enclosed portion 27 is domed inwardly 28 into the cup (see FIG. 6*b*). However, in an alternative embodiment, the enclosed portion 27 may instead be domed outwardly outside of the cup.

Ideally, the clamping loads applied during this stretching operation are sufficient to ensure that little or no material from the clamped annular region 26 (or the sidewall 24) flows into the enclosed portion 27 during stretching. This helps to maximize the amount of stretching and thinning that occurs in the domed region 28. However, as indicated above in the general description of the invention, it has been found that stretching and thinning of the enclosed portion 27 can still occur when permitting a limited amount of flow of material from the clamped annular region 26 (or from outside of the clamped region) into the enclosed portion.

In summary, this stretching operation and the resulting thinning of the base 25 is critical to achieving the object of the invention, namely to make a cup or container body having a base thickness which is less than that of the ingoing gauge of the metal sheet.

In an alternative embodiment shown in FIG. 7, the sidewall 24 rather than the base 25 is clamped during the stretching operation. FIG. 7 shows an annular region 26 of the sidewall adjacent the base being clamped between cup holder 370 and clamping element 360. Either or both of the cup holder 370 and clamping element 360 may be segmented to facilitate the clamping of the sidewall, and to accommodate cups of different sizes. The annular clamping of the sidewall 24 defines an enclosed portion 27 inward of the clamped annular region 26 (see FIG. 7). A stretch punch 35 is also indicated in FIG. 7. Note that other features of the stretch rig are excluded from FIG. 7 for ease of understanding.

In a further alternative embodiment, the single stretch punch 35 is replaced by a punch assembly 350 (as shown in FIG. 8). The punch assembly 350 has:

i. a first group 351 of two annular punch elements 351*a,b* surrounding a central core punch element 351*c*; and ii. a second group 352 of two annular punch elements 352*a,b*.

For ease of understanding, FIG. 8 only shows the punch assembly 350 and the drawn cup 23. Although not shown on FIG. 8, in use, an annular region 26 of the cup's base 25 would be clamped during the stretching operation in a similar manner to the embodiment shown in FIGS. 6*a* and 6*b*.

In use, the first and second groups of punch elements 351, 352 face opposing surfaces of the enclosed portion 27. The stretching operation is performed by moving both first and second groups of punch elements 351, 352 towards each other to deform and stretch (thin) the enclosed portion 27. The enclosed portion 27 is deformed into an undulating profile 29 (see FIG. 8).

In a further embodiment, a single stretch punch 35 has a number of relief features in the form of recesses/cut-outs 353 provided in its end face (see FIG. 9). In the embodiment shown, there is a central recess/cut-out surrounded by a single annular recess/cut-out. However, alternative configurations of recess/cut-out may be used.

(Re-)Drawing Operation on Stretched Cup

For the embodiment of the invention shown in FIGS. 6*a* and 6*b*, the stretched cup with its thinned and domed region 28 in the base is transferred to a bodymaker assembly 40 (see FIGS. 10*a* to 10*d*). The bodymaker assembly 40 comprises two halves 41, 42 (indicated by arrows in FIGS. 10*a* to 10*d*).

The first half 41 of the bodymaker assembly 40 has a tubular re-draw punch 43 mounted on the same axis as circumferential clamp ring 44. As can be seen from FIGS. 10*a* to 10*d*, the clamp ring 44 circumferentially surrounds the re-draw punch 43 like a sleeve. As will be understood from the following description and looking at FIGS. 10*a* to 10*d*, the re-draw punch 43 is moveable through and independently of the circumferential clamp ring 44.

The second half 42 of the bodymaker assembly 40 has a re-draw die 45. The re-draw die 45 has a tubular portion having an outer diameter corresponding to the internal diameter of the stretched cup 23 (see FIG. 10*a*). The re-draw die 45 has a forming surface 46 along its inner axial surface, which terminates in an annular end face 47 (see FIGS. 10*a* to 10*d*). The annular end face 47 of the re-draw die 45 corresponds in width to that of the annular region 26 of the base of the stretched cup.

In use, the stretched cup 23 is first mounted on the re-draw die 45 (as shown on FIG. 10*a*). Then, as shown in FIG. 10*b*, the two halves 41, 42 of the bodymaker assembly 40 are moved axially relative to each other so that the annular region 26 of the base of the stretched cup is clamped between the annular end face 47 of the re-draw die 45 and the surface of the circumferential clamp ring 44.

Once clamped, the re-draw punch 43 is then forced axially through the clamp ring 44 and the re-draw die 45 (see arrow A on FIGS. 10*c* and 10*d*) to progressively re-draw the material of the stretched cup along the forming surface 46 of the re-draw die. The use of the re-draw die 45 has two effects:

i. to cause material from the sidewall 24 to be drawn radially inwards and then axially along the forming surface 46 of the re-draw die 45 (as indicated by arrows B on FIGS. 10*c* and 10*d*). In this way, the cup is reduced in diameter (as indicated by comparing FIG. 10*a* with FIG. 10*d*); and ii. to cause the stretched and thinned material in the domed region 28 of the base to be progressively pulled out and transferred from the base into the reduced diameter sidewall (as indicated by arrows C on FIGS. 10*c* and 10*d*). This has the effect of flattening the domed region 28 of the base (see especially FIG. 10*d*).

FIG. 10*d* shows the final state of the re-drawn cup 23 when the re-draw punch 43 has reached the end of its stroke. It can clearly be seen that the formerly domed region 28 of the base has been pulled essentially flat, to provide a cup or container body 23 where the thickness of the base 25 is thinner than that of the ingoing blank 21. As stated earlier, this reduced thickness in the base 25—and the consequent weight reduction—is enabled by the stretching operation performed previously.

As shown in the detail view of the re-draw die 45 in FIG. 11, the junction between the forming surface 46 and the annular end face 47 of the re-draw die is provided with a radius R45 in the range 1 to 3.2 mm. The provision of a radius R45 alleviates the otherwise sharp corner that would be present at the junction between the forming surface 46 and the annular end face 47, and thereby reduces the risk of the metal of the stretched cup 23 tearing when being re-drawn around this junction.

Note that although FIGS. 10*a* to 10*d* show use of a tubular re-draw punch 43 having an annular end face, the punch may alternatively have a closed end face. The closed end face may be profiled to press a corresponding profile into the base of the cup.

The drawing operation described above and illustrated in FIGS. 10*a* to 10*d* is known as reverse re-drawing. This is because the re-draw punch 43 is directed to invert the profile of the stretched cup. In effect, the re-draw punch reverses the direction of the material and turns the stretched cup inside out. This can be seen by comparing the cup profiles of FIGS. 10*a* and 10*d*. Reverse re-drawing the cup in this context has the advantages of:

i. preventing uncontrolled buckling of the domed region 28 of the base of the stretched cup (especially when using a re-draw punch having a closed end face); and ii. maximizing transfer of material from the domed region 28 to the sidewalls 24.

Note that although the embodiment shown in FIGS. 10*a* to 10*d* illustrates reverse re-drawing, conventional re-drawing would also work; i.e. where the re-draw punch acts in the opposite direction to reverse re-drawing and does not turn the cup inside out.

FIG. 12 shows the changes undergone by the metal blank 21 from a) before any forming operations have been undertaken, to b) forming into the first stage cup in the cupping press 10, to c) the stretching and thinning operation performed in the stretch rig 30, to d) the re-drawn cup that results from the bodymaker assembly 40. A location on the domed region 28 of the stretched cup is indicated as X on FIG. 12. The figure illustrates the effect of the re-drawing operation in radially pulling out X to X'. The figure shows that the base of the cup at that location after stretching (t stretch) (and after the re-drawing operation) has a reduced thickness relative to the ingoing gauge of the blank 21 (t in-going), i.e. t stretch<t in-going. As previously stated, this thinning of the base is enabled by the stretching operation.

To maximize the height of the sidewall 24 of the cup with its thinned base, the re-drawn cup may also undergo ironing of the sidewalls by being drawn through a succession of ironing dies (not shown). This ironing operation has the effect of increasing the height and decreasing the thickness of the sidewall, and thereby maximizing the enclosed volume of the cup.

Stretching Operation, Second Illustrative Method

According to a second method of forming the intermediate cup that is shown in FIGS. 6*a* and 6*b*, a flat section of metal sheet 10' is located within a stretch rig 20' (an example of which is illustrated in FIGS. 13*a* and 13*b*). Steel tin-plate (Temper 4) with an ingoing gauge thickness (t in-going) of 0.280 mm has been used for the metal sheet 10'. However, the invention is not limited to particular gauges or metals. The section of metal sheet 10' is typically cut from a roll of metal sheet (not shown). The stretch rig 20' has two platens 21', 22' that are moveable relative to each other along parallel axes 23' under the action of loads applied through cylinders 24' (see FIGS. 13*a* and 13*b*). The loads may be applied by any conventional means, e.g. pneumatically, hydraulically or through high-pressure nitrogen cylinders.

On platen 21' is mounted a stretch punch 25' and a clamping element in the form of a first clamp ring 26'. The first clamp ring 26' is located radially outward of the stretch punch 25'. The stretch punch 25' is provided with a domed end face (see FIGS. 13*a* and 13*b*).

On platen 22' is mounted a second clamp ring 27'. The second clamp ring 27' is a tubular insert having an annular end face 28' (see FIGS. 13*a* and 13*b*). In use, loads are applied via the cylinders 24' to move platens 21', 22' towards each other along axes 23' until the flat section of metal sheet 10' is clamped firmly in an annular manner between the first and second clamp rings 26', 27' to define a clamped annular region 15' on the section of metal sheet. The clamped annular region 15' defines an enclosed portion 16' on the metal sheet 10'.

The stretch punch 25' is then moved axially through the first clamp ring 26' to progressively deform and stretch (thin) the metal of the enclosed portion 16' into a domed enclosed portion 17' (see FIG. 13*b*).

Ideally, the clamping loads applied during this stretching operation are sufficient to ensure that little or no material from the clamped annular region 15' flows into the enclosed portion 16' during stretching. This helps to maximize the amount of stretching and thinning that occurs in the enclosed portion 16'. However, as indicated above in the general description of the invention, it has been found that stretching and thinning of the metal of the enclosed portion 16' can still occur when permitting a limited amount of flow of metal from the clamped annular region 15' (or from outside of the clamped region) into the enclosed portion.

In an alternative embodiment, the single stretch punch 25' is replaced by a punch assembly 250' (as shown in FIG. 14). The punch assembly 250' has:

i. a first group 251' of two annular punch elements 251*a',b'* surrounding a central core punch element 251*c*; and ii. a second group 252' of two annular punch elements 252*a',b'*.

For ease of understanding, FIG. 14 only shows the punch assembly 250' and the section of metal sheet 10'. Although not shown on FIG. 6', in use an annular region 15' of the metal sheet 10' would be clamped during the stretching operation in a similar annular manner to the embodiment shown in FIGS. 13*a* and 13*b*.

In use, the first and second groups of punch elements 251', 252' face opposing surfaces of the enclosed portion 16' of the metal sheet 10'. The stretching operation is performed by moving both first and second groups of punch elements 251', 252' towards each other to deform and stretch (thin) the metal of the enclosed portion 16'. The enclosed portion 16' is deformed into an undulating profile 170' (see FIG. 14).

In a further embodiment, a single stretch punch 25' has a number of relief features in the form of recesses/cut-outs 253' provided in its end face (see FIG. 15). In the embodiment shown in FIG. 15, there is a central recess/cut-out surrounded by a single annular recess/cut-out. However, alternative configurations of recess/cut-out may be used.

The embodiment in FIGS. 5*a'*, 5*b'* is shown punching a single enclosed portion in a section of metal sheet 10'. However, the apparatus shown in FIGS. 5*a'*, 5*b'* can used to stretch and thin a plurality of enclosed portions 16' separated from each other and disposed across the area of the metal sheet 10'. FIG. 16 shows the section of metal sheet 10' having undergone such a stretching operation to define a number of stretched and thinned domed enclosed portions 16', 17' disposed across the area of the sheet. Whilst this be done using a single stretch punch performing a number of successive stretching operations across the area of the metal sheet 10', it is preferred that the apparatus includes a plurality of stretch punches which allow simultaneous stretching operations to be performed on a corresponding number of enclosed portions disposed across the area of the metal sheet. However, to reduce the loads imposed on the tooling used for stretching, it is beneficial to stagger any simultaneous stretching operations so that not all of the enclosed portions across the sheet are stretched at the same time. FIGS. 17*a* and 17*b* indicate six groups of enclosed portions—'a', 'b', 'c', 'd', 'e' and 'f'. In use, all the enclosed portions in each group would be stretched simultaneously. In the embodiment shown in FIG. 17*a*, the stretching would progress radially outwardly from group 'a', to group 'b', to group 'c', to group 'd', to group 'e', to group 'f'. In the alternative embodiment shown in FIG. 9*b*, the stretching would progress radially inwardly from group 'f', group 'e', to group 'd', to group 'c', to group 'b', to group 'a'. On completion of the stretching, separate blanks would be cut from the stretched metal sheet for subsequent drawing.

Note that FIGS. 16, 17*a* and 17*b* are illustrative only and are not intended to be to scale.

Initial Drawing Stage of Drawing Operation, Second Illustrative Method

On completion of the stretching operation, the metal sheet 10' with its stretched and thinned domed enclosed portion 16', 17' is moved to a cupping press 30'. The cupping press 30' has a draw pad 31' and a draw die 32' (see FIGS. 11*a* and 11*b*). A draw punch 33' is co-axial with the draw die 32', as indicated by common axis 34'. The draw punch 33' is provided with a recess 35'. A circumferential cutting element 36' surrounds the draw pad 31'.

In use, the section of metal sheet 10' is held in position between opposing surfaces of the draw pad 31' and the draw die 32'. The sheet 10' is located so that the domed enclosed portion 16', 17' is centrally located above the bore of the draw die 32'. After the metal sheet 10' has been positioned, the circumferential cutting element 36' is moved downwards to cut a blank 11' out from the metal sheet 10' (see FIG. 18*a*). The excess material is indicated by 12' on FIG. 18*a*.

After the blank 11' has been cut from the sheet 10', the draw punch 33' is moved axially downwards into contact with the blank 11' (see FIG. 18*b*). The draw punch 33' first contacts the blank 11' on an annular region 18*a*' located adjacent and radially outward of the domed enclosed portion 16', 17' (see FIG. 18*a*). The recess 35' provided in the draw punch 33' avoids crushing of the domed enclosed portion 16', 17' during drawing. The draw punch 33' continues moving downwardly through the draw die 32' to progressively draw the blank 11' against the forming surface 37' of the die into the profile of a cup 19' having a sidewall 19'*sw* and integral base 19'*b*. However, the action of the draw punch 33' against the blank 11' also causes material of the domed enclosed portion 16', 17' to be pulled and transferred outwardly (as indicated by arrows A in FIG. 18*b*). This initial drawing stage results in a reduction in height of the domed region due to its material having been drawn outwardly. Dependent on the depth of the draw, the drawing may be sufficient to pull and transfer some of the stretched and thinned material of the domed enclosed portion 16', 17' into the sidewall 19'*sw* during this initial drawing stage, rather than this stretched and thinned material remaining wholly within the base 19'*b*. FIG. 18*b* includes a separate view of the drawn cup 19' that results from use of the cupping press 30', with the reduced height domed enclosed portion 17'. A detail view is included in FIG. 18*a* of the radius R32 at the junction between the end face of the draw die 32' and its forming surface 37'. As for conventional drawing operations, the radius R32 and the load applied by the draw pad 31' to the periphery of the blank 11' are selected to permit the blank to slide radially inwards between the opposing surfaces of the draw pad 31' and draw die 32' and along forming surface 37' as the draw punch 33' moves progressively downwards to draw the blank into the cup 19'. This ensures that the blank 11' is predominantly drawn, rather than stretched (thinned) (or worse, torn about the junction between the end face of the draw die and the forming surface 37'). Dependent on the size of radius R32 and, to a lesser extent, the severity of the clamping load applied by the draw pad 31', negligible stretching or thinning should occur during this initial drawing stage. However, in alternative embodiments of the invention, it is permissible for the load applied by the draw pad 31' to be sufficient that a combination of drawing and further stretching occurs under the action of the draw punch 33'. The cup 19' that results from this initial drawing stage is also referred to the "first stage cup".

In an alternative embodiment of the invention not shown in FIGS. 18*a* and 18*b*, if the depth of draw were sufficient it would result in the domed enclosed portion 16', 17' being pulled essentially flat in this initial drawing stage to define a cup 19' having an essentially flat base 19'*b*.

The first stage cup 19' resulting from the cupping process shown in FIGS. 18*a* and 18*b* and described above is transferred to a bodymaker assembly 40, where redrawing processes may be performed as described with respect to stretched cup 23.

FIG. 19 shows the changes undergone by the metal sheet 10' from before any forming operations have been undertaken (view a), to after the stretching operation in the stretch rig 20' (view b), to after the initial drawing stage in the cupping press 30' (view c), and finally to after the re-drawing stage in the bodymaker assembly 40' (view d). The figures clearly show that the base of the final cup (t stretch) has a reduced thickness relative to the ingoing gauge of the metal sheet 10' (t in-going), i.e. t stretch<t in-going. As previously stated, this reduced thickness (relative to the ingoing gauge of the metal sheet) is enabled by the stretching process of the invention. The effect of the initial drawing stage in progressively pulling and transferring outward material of the domed enclosed portion 16', 17' is shown on views b and c of FIG. 19, with material at location X pulled and transferred outward to location X' as a result of the initial drawing stage. The effect of the re-drawing stage is shown in view d of FIG. 19, with material at location X' pulled and transferred to location X" in the sidewall 19'*sw*.

To maximize the height of the sidewall 19'*sw* of the cup with its thinned base, the cup may also undergo ironing of the sidewalls by being drawn through a succession of ironing dies (not shown) in an ironing operation. This ironing operation has the effect of increasing the height and decreasing the thickness of the sidewall.

FIG. 20 is a schematic view a container 100 where either the final resulting cup 19' (or stretched cup 23) serves as container body 110. Preferably, the cup 19' (or stretched cup 23) undergoes a conventional ironing process (not shown in the figures) to achieve a desired sidewall thickness. The container body 110 is flared outwardly into a flange 111 at its access opening. Can end 120 is provided with a seaming panel 121 that enables the can end to be fastened to the container body by seaming to flange 111. For discussion of the cup or can body, the term "intermediate cup" refers to cups, such as 19' or 23, that may be formed from the above methods, and the term "can body" refers to the structure the cup after an ironing process.

FIG. 21 is a graph of material thickness distribution and Rockwell hardness distribution of a stretched cup 123, which was prepared according to the first method (cup stretching) described above from conventional tin plate (that is, continuously annealed, T4) of 0.110 inch thickness. FIG. 22 shows a cross section of a can body base 124 after redrawing and ironing process. The locations labeled on base 124 correspond to the locations labeled on cup 123 shown in FIG. 21.

Base 124 includes a relatively planar, un-beaded central panel 130 at its center, a boss or recess 132 surrounding bottom panel 130, and a peripheral bead 134. Panel 130, recess 132, and bead 134 together form a bottom panel 140. Bead 134 yields to an inboard wall of a countersink bead 136, the bottom of which forms a standing surface on which the can body rests. The upper wall of bead 134 preferably smoothly yields to the can body sidewall. As bottom panel 140 is relatively unstructured, base 124 may be considered to be un-domed.

The following information describes the cup 123 and the base 124 of the can body according to attributes of thickness distribution, hardness distribution, and micro-grain structure. Each thickness, hardness, and grain aspect ratio value provided herein depends on the incoming sheet thickness, hardness, annealing, chemistry, and the like, and depending on the desired attributes of the container, degree of redrawing desired, end goal of the container, and other well-known parameters. For the thickness and hardness distributions, measurements are taken radially from the center along the grain direction, which is apparent from rolling marks on the sheet. The values and ranges for thickness, hardness, and grain aspect ratio provided herein apply to the can body before any baking or ovening process, but also to the finished can body that is seamed together with an end.

As illustrated in FIG. 21, the thickness of cup 123 monotonically decreases from 0.097 inches from the center at point zero to 0.095 inches at point 3, and increases until point 8 near the boundary of the stretched region of the cup. The numeric average thickness of the stretched base from center point zero to point 9 (near the stretched dome edge) is 0.0099 inches (an average thickness reduction of 9.8%), and an average thickness of the stretched base of point zero through point 6 (that is, bottom panel 140) is 0.0096 inches (an average wall thickness reduction of 12.2%).

The inventors surmise that either can bottom panels or the overall stretched portion of the cup, when formed of conventional tinplate, such as CA, T4 plate, having a starting thickness of approximately 0.011 or 0.0115 inches, can be formed in a thickness range of between 0.006 and 0.015 inches, more preferably between 0.008 and 0.010 inches. Thickness reductions of at least 2%, preferably between 5% and 30%, more preferably between 10% and 25% are contemplated.

As expected because of work hardening relating to the stretching process, the hardness values inversely correlate to the thickness values. Hardness values described throughout this specification are identified in terms of Rockwell hardness numbers on the 30T scale. The incoming raw sheet Rockwell hardness number of 58 (RH T-30)) is significantly increased throughout the stretched region of points 0 through 9 to a minimum number of 63 (an increase of 8.6%) and an average number of 66 (an increase of 13.8%). For bottom panel 140, the minimum hardness number is 65 (an increase of 12.1%) and the average hardness number is 66.7 (an increase in 15.0%).

The inventors surmise that a hardness number throughout can bottom 140 may be achieved of at least 63, preferably between 63 and 75, and more preferably between 64 and 70. Moreover, the inventors surmise that the average hardness number of can bottom 140 preferably is at least 64, preferably 64 to 70, and more preferably 68. An increase in average hardness number of can bottom 140 from incoming raw sheet of at least 5 on the RH scale, and more particularly between 5 and 17, between 6 and 15, between 7 and 12, and between 8 and 10, is believed to be achievable and beneficial. The increase in average RH number of can bottom 140 is at least 7%, preferably between 8% and 21%, more preferably between 10% and 16%, and more preferably between 12% and 15%. As shown in FIG. 21, the increase in average Rockwell Hardness number in the example is approximately 8 over the entire stretched cup, and 8.7 in bottom plate 140.

FIGS. 23 and 24 are photomicrographs of a polished and etched can cross section taken at or near the center of the respective can bottoms, in general accordance with ASTM E 112 and according to industry practice. FIG. 23 shows a cross section of a drawn and ironed can formed of conventional tinplate (CA, T4). Because conventional DWI processes do not appreciably work the bottom center of the can, the micrograph of FIG. 23 is believed to be very close to the structure of incoming raw sheet. FIG. 24 shows a cross section of a can formed according to the methods described above.

Upon preparing the samples to identify grain boundaries, an aspect ratio of the grains may be identified by measuring the grain length in the rolling direction (that is, horizontally in the orientation of FIGS. 23 and 24) and dividing it by the grain dimension perpendicular to the rolling direction (that is, vertically in the orientation of FIGS. 23 and 24). The inventors surmise that the average grain aspect ratio of a can body formed according to the present invention taken at the bottom center of the center panel (corresponding to point zero in FIG. 22) is at least 1.4, preferably between 1.5 and 2.5, more preferably between 1.6 and 2.2. In the example of FIG. 24, the average aspect ratio is about 1.8. The inventors surmise can base 124 will have an increase (compared with raw sheet) of at least 20%, preferably between 20% and 100%, more preferably between 30% and 70%, and more preferably between 40% and 60%. The averages may be taken by choosing representative grains.

The above measurements provide an illustration of aspects of the present invention; other values and the ranges herein are based on the inventors' estimations of achievable and feasible capabilities of the technology described herein.

What is claimed is:

1. A drawn and ironed T4 tin plate can body adapted for seaming onto a can end, the can body comprising:

an ironed sidewall;

an unironed, enclosed, undomed base integrally formed with the sidewall, a bottom panel of the base having an average Rockwell 30T hardness number that is more than 64.

2. The can body of claim 1 wherein average Rockwell 30T hardness number is between 64 and 70.

3. The can body of claim 1 wherein average Rockwell 30T hardness number is approximately 68.

4. The can body of claim 1 wherein the base panel has an average thickness of between about 0.006 inches and 0.015 inches.

5. The can body of claim 1 wherein the sidewall has a flange capable of being double seamed to a curl of a can end.

* * * * *